US009125455B2

(12) United States Patent
Kerns et al.

(10) Patent No.: US 9,125,455 B2
(45) Date of Patent: Sep. 8, 2015

(54) GUIDES FOR LACING SYSTEMS

(71) Applicant: Boa Technology, Inc., Denver, CO (US)

(72) Inventors: Mark Kerns, Golden, CO (US); Mark Soderberg, Conifer, CO (US); Adam Auell, Morrison, CO (US); Kristopher Lovett, Denver, CO (US)

(73) Assignee: Boa Technology Inc., Denver, CO (US)

( * ) Notice: Subject to any disclaimer, the term of this patent is extended or adjusted under 35 U.S.C. 154(b) by 0 days.

(21) Appl. No.: 14/534,924

(22) Filed: Nov. 6, 2014

(65) Prior Publication Data

US 2015/0059208 A1 Mar. 5, 2015

Related U.S. Application Data

(63) Continuation of application No. 14/268,498, filed on May 2, 2014, which is a continuation of application No. 13/011,707, filed on Jan. 21, 2011, now Pat. No. 8,713,820.

(60) Provisional application No. 61/297,023, filed on Jan. 21, 2010.

(51) Int. Cl.
*A43B 5/00* (2006.01)
*A43C 1/00* (2006.01)
(Continued)

(52) U.S. Cl.
CPC ..... *A43C 1/00* (2013.01); *A43B 3/0052* (2013.01); *A43B 5/00* (2013.01); *A43C 5/00* (2013.01);
(Continued)

(58) Field of Classification Search
CPC ..... A43C 1/00; A43C 1/04; A43C 5/00
USPC ..... 36/50.1
See application file for complete search history.

(56) References Cited

U.S. PATENT DOCUMENTS 59,332 A 10/1866 White et al.
80,834 A 8/1868 Prussia
(Continued)

FOREIGN PATENT DOCUMENTS

AT 127075 2/1932
AT 244804 1/1966
(Continued)

OTHER PUBLICATIONS

ASOLO® Boot Brochure Catalog upon information and belief date is as early as Aug. 22, 1997.
(Continued)

*Primary Examiner* — Marie Bays
(74) *Attorney, Agent, or Firm* — Kilpatrick Townsend & Stockton LLP

(57) ABSTRACT

Lacing systems are disclosed for use with footwear or other articles. The lacing system can comprises flexible webbing lace guides. In some embodiments, a lace guide can include a first lace guide element and a second lace guide element. The lace can pass through the first and second lace guides consecutively on the first side of the article before crossing to the opposing side of the article. The first and second lace guide elements can be angled towards each other to reduce the occurrence of sharp turns in the lace path through the lace guide elements. In some embodiments, the lace guide can have a central portion that is less flexible than the end portions so as to reduce the occurrence of sharp turns in the lace path through the lace guide when tension is applied to the lace.

20 Claims, 16 Drawing Sheets

(51) Int. Cl.

| | |
|---|---|
| ***A43B 3/00*** | (2006.01) |
| ***A43C 5/00*** | (2006.01) |
| ***A43C 11/12*** | (2006.01) |
| ***A43C 11/16*** | (2006.01) |
| ***A43C 11/20*** | (2006.01) |
| ***A43C 7/02*** | (2006.01) |
| ***A43C 7/06*** | (2006.01) |
| ***A43C 11/00*** | (2006.01) |

(52) U.S. Cl.
CPC ... *A43C 7/02* (2013.01); *A43C 7/06* (2013.01); *A43C 11/004* (2013.01); *A43C 11/12* (2013.01); *A43C 11/16* (2013.01); *A43C 11/165* (2013.01); *A43C 11/20* (2013.01)

(56) References Cited

U.S. PATENT DOCUMENTS

| | | | |
|---|---|---|---|
| 117,530 | A | 8/1871 | Foote |
| 228,946 | A | 6/1880 | Schulz |
| 230,759 | A | 8/1880 | Drummond |
| 746,563 | A | 12/1903 | McMahon |
| 819,993 | A | 5/1906 | aws et al. |
| 908,704 | A | 1/1909 | Sprinkle |
| 1,060,422 | A | 4/1913 | Bowdish |
| 1,062,511 | A | 5/1913 | Short |
| 1,083,775 | A | 1/1914 | Thomas |
| 1,090,438 | A | 3/1914 | Worth et al. |
| 1,170,472 | A | 2/1916 | Barber |
| 1,288,859 | A | 12/1918 | Feller et al. |
| 1,390,991 | A | 9/1921 | Fotchuk |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,429,657 | A | 9/1922 | Trawinski |
| 1,481,903 | A | 4/1923 | Hart |
| 1,466,673 | A | 9/1923 | Solomon et al. |
| 1,530,713 | A | 2/1924 | Clark |
| 1,502,919 | A | 7/1924 | Seib |
| 1,862,047 | A | 6/1932 | Boulet et al. |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,907,086 | A | 10/1959 | Ord |
| 2,991,523 | A | 7/1961 | Del Conte |
| 3,035,319 | A | 5/1962 | Wolff |
| 3,112,545 | A | 12/1963 | Williams |
| 3,163,900 | A | 1/1965 | Martin |
| 3,169,325 | A | 2/1965 | Fesl |
| 3,193,950 | A | 7/1965 | Shu-Lien Liou |
| 3,197,155 | A | 7/1965 | Chow |
| 3,221,384 | A | 12/1965 | Aufenacker |
| 3,276,090 | A | 10/1966 | Nigon |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,934,346 | A | 1/1976 | Sasaki et al. |
| 3,975,838 | A | 8/1976 | Martin |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,408,403 | A | 10/1983 | Martin |
| 4,433,456 | A | 2/1984 | Baggio |
| 4,463,761 | A | 8/1984 | Pols et al. |
| 4,480,395 | A | 11/1984 | Schoch |
| 4,507,878 | A | 4/1985 | Semouha |
| 4,551,932 | A | 11/1985 | Schoch |
| 4,555,830 | A | 12/1985 | Petrini et al. |
| 4,574,500 | A | 3/1986 | Aldinio et al. |
| 4,616,524 | A | 10/1986 | Bidoia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,870,723 | A | 10/1989 | Pozzobon et al. |
| 4,870,761 | A | 10/1989 | Tracy |
| 4,884,760 | A | 12/1989 | Baggio et al. |
| 4,924,605 | A | 5/1990 | Spademan |
| 4,937,953 | A | 7/1990 | Walkhoff |
| 4,961,544 | A | 10/1990 | Biodia |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | DeBortoli |
| 5,065,481 | A | 11/1991 | Walkhoff |
| 5,117,567 | A | 6/1992 | Berger |
| 5,152,038 | A | 10/1992 | Schoch |
| 5,157,813 | A | 10/1992 | Carroll |
| 5,158,428 | A | 10/1992 | Gessner et al. |
| 5,177,882 | A | 1/1993 | Berger |
| 5,181,331 | A | 1/1993 | Berger |
| 5,184,378 | A | 2/1993 | Batra |
| D333,552 | S | 3/1993 | Berger et al. |
| 5,249,377 | A | 10/1993 | Walkhoff |
| 5,259,094 | A | 11/1993 | Zepeda |
| 5,315,741 | A | 5/1994 | Debberke |
| 5,319,868 | A | 6/1994 | Hallenbeck |
| 5,319,869 | A | 6/1994 | McDonald et al. |
| 5,325,613 | A | 7/1994 | Sussmann |
| 5,327,662 | A | 7/1994 | Hallenbeck |
| 5,335,401 | A | 8/1994 | Hanson |
| 5,341,583 | A | 8/1994 | Hallenbeck |
| 5,345,697 | A | 9/1994 | Quellais |
| 5,355,596 | A | 10/1994 | Sussmann |
| 5,357,654 | A | 10/1994 | Hsing-Chi |
| 5,371,957 | A | 12/1994 | Gaudio |
| 5,381,609 | A | 1/1995 | Hieblinger |
| 5,392,535 | A | 2/1995 | Van Noy et al. |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,463,822 | A | 11/1995 | Miller |
| 5,477,593 | A | 12/1995 | Leick |

(56) References Cited

U.S. PATENT DOCUMENTS 5,502,902 A 4/1996 Sussmann
5,511,325 A 4/1996 Hieblinger
5,535,531 A 7/1996 Karabed et al.
5,537,763 A 7/1996 Donnadieu et al.
5,557,864 A 9/1996 Marks
5,566,474 A 10/1996 Leick et al.
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,692,319 A * 12/1997 Parker et al. ..... 36/50.1
5,718,021 A 2/1998 Tatum
5,718,065 A 2/1998 Locker
5,720,084 A 2/1998 Chen
5,732,483 A 3/1998 Cagliari
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,068 A 8/1998 Bernier et al.
5,819,378 A 10/1998 Doyle
5,845,371 A 12/1998 Chen
5,909,946 A 6/1999 Okajima
5,934,599 A 8/1999 Hammerslag
5,937,542 A 8/1999 Bourdeau
5,956,823 A 9/1999 Borel
6,052,921 A 4/2000 Oreck
6,070,886 A 6/2000 Cornelius et al.
6,083,857 A 7/2000 Bottger
6,088,936 A 7/2000 Bahl
6,102,412 A 8/2000 Staffaroni
D430,724 S 9/2000 Matis et al.
6,119,372 A 9/2000 Okajima
6,148,489 A 11/2000 Dickie et al.
6,202,953 B1 3/2001 Hammerslag
6,240,657 B1 6/2001 Weber et al.
6,267,390 B1 7/2001 Maravetz et al.
6,286,233 B1 9/2001 Gaither
6,289,558 B1 9/2001 Hammerslag
6,311,633 B1 11/2001 Keire
6,401,364 B1 6/2002 Burt
6,416,074 B1 7/2002 Maravetz et al.
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,606,804 B2 8/2003 Kaneko et al.
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,792,702 B2 9/2004 Borsoi et al.
6,802,439 B2 10/2004 Azam et al.
6,823,610 B1 11/2004 Ashley
6,877,256 B2 4/2005 Martin et al.
6,922,917 B2 8/2005 Kerns et al.
6,938,913 B2 9/2005 Elkington
6,945,543 B2 9/2005 De Bortoli et al.
6,976,972 B2 12/2005 Bradshaw
6,993,859 B2 2/2006 Martin et al.
D521,226 S 5/2006 Douglas et al.
7,076,843 B2 7/2006 Sakabayashi
7,082,701 B2 8/2006 Dalgaard et al.
7,096,559 B2 8/2006 Johnson et al.
7,134,224 B2 11/2006 Elkington et al.
7,281,341 B2 10/2007 Reagan et al.
7,293,373 B2 11/2007 Reagan et al.
7,331,126 B2 2/2008 Johnson
7,343,701 B2 3/2008 Pare et al.
7,367,522 B2 5/2008 Chen
7,386,947 B2 6/2008 Martin et al.
7,392,602 B2 7/2008 Reagan et al.
7,401,423 B2 7/2008 Reagan et al.
7,490,458 B2 2/2009 Ford
7,568,298 B2 8/2009 Kerns
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,624,517 B2 12/2009 Smith
7,648,404 B1 1/2010 Martin
7,650,705 B2 1/2010 Donnadieu et al.
7,694,354 B2 4/2010 Philpott et al.
7,752,774 B2 7/2010 Ussher
7,757,412 B2 7/2010 Farys
7,774,956 B2 * 8/2010 Dua et al. ..... 36/50.1
7,841,106 B2 11/2010 Farys
7,871,334 B2 1/2011 Young et al.
7,877,845 B2 2/2011 Signori
7,908,769 B2 3/2011 Pellegrini
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
D646,790 S 10/2011 Castillo et al.
8,056,150 B2 11/2011 Stokes et al.
8,074,379 B2 12/2011 Robinson, Jr. et al.
8,091,182 B2 1/2012 Hammerslag et al.
8,109,015 B2 2/2012 Signori
D663,850 S 7/2012 Joseph
D663,851 S 7/2012 Joseph
8,215,033 B2 7/2012 Carboy et al.
8,231,074 B2 7/2012 Hu et al.
D665,088 S 8/2012 Joseph
8,235,321 B2 8/2012 Chen
8,245,371 B2 8/2012 Chen
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,434,200 B2 5/2013 Chen
8,490,299 B2 7/2013 Dua et al.
8,578,632 B2 11/2013 Bell et al.
8,713,820 B2 * 5/2014 Kerns et al. ..... 36/50.1
2002/0050076 A1 5/2002 Borsoi et al.
2002/0062579 A1 5/2002 Caeran
2002/0129518 A1 9/2002 Borsoi et al.
2002/0148142 A1 10/2002 Oorei et al.
2002/0166260 A1 * 11/2002 Borsoi ..... 36/50.1
2002/0178548 A1 12/2002 Freed
2003/0079376 A1 5/2003 Oorei et al.
2003/0177662 A1 9/2003 Elkington et al.
2003/0204938 A1 11/2003 Hammerslag
2005/0054962 A1 3/2005 Bradshaw
2005/0060912 A1 3/2005 Holer
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0198866 A1 9/2005 Wiper et al.
2006/0156517 A1 7/2006 Hammerslag et al.
2006/0179685 A1 8/2006 Borel et al.
2006/0185193 A1 8/2006 Pellegrini
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke

(56) References Cited

U.S. PATENT DOCUMENTS

| | | | | |
|---|---|---|---|---|
| 2007/0169378 | A1 | 7/2007 | Sodeberg et al. | |
| 2008/0016717 | A1 | 1/2008 | Ruban | |
| 2008/0060167 | A1 | 3/2008 | Hammerslag et al. | |
| 2008/0060168 | A1 | 3/2008 | Hammerslag et al. | |
| 2008/0066272 | A1 | 3/2008 | Hammerslag et al. | |
| 2008/0066345 | A1 | 3/2008 | Hammerslag et al. | |
| 2008/0066346 | A1 | 3/2008 | Hammerslag et al. | |
| 2008/0083135 | A1 | 4/2008 | Hammerslag et al. | |
| 2008/0172848 | A1 | 7/2008 | Chen | |
| 2009/0071041 | A1* | 3/2009 | Hooper | 36/3 A |
| 2009/0090029 | A1 | 4/2009 | Kishino | |
| 2009/0172928 | A1 | 7/2009 | Messmer et al. | |
| 2009/0184189 | A1 | 7/2009 | Soderberg et al. | |
| 2009/0277043 | A1* | 11/2009 | Graser et al. | 36/91 |
| 2010/0064547 | A1* | 3/2010 | Kaplan et al. | 36/10 |
| 2010/0101061 | A1 | 4/2010 | Ha | |
| 2010/0154254 | A1 | 6/2010 | Fletcher | |
| 2010/0175163 | A1 | 7/2010 | Litke | |
| 2010/0251524 | A1 | 10/2010 | Chen | |
| 2010/0319216 | A1 | 12/2010 | Grenzke et al. | |
| 2011/0000173 | A1 | 1/2011 | Lander | |
| 2011/0071647 | A1 | 3/2011 | Mahon | |
| 2011/0167543 | A1 | 7/2011 | Kovacevich et al. | |
| 2011/0191992 | A1 | 8/2011 | Chen | |
| 2011/0197362 | A1 | 8/2011 | Chella et al. | |
| 2011/0258876 | A1 | 10/2011 | Baker et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0005995 | A1 | 1/2012 | Emery | |
| 2012/0023717 | A1 | 2/2012 | Chen | |
| 2012/0101417 | A1 | 4/2012 | Joseph | |
| 2012/0102783 | A1 | 5/2012 | Swigart et al. | |
| 2012/0157902 | A1 | 6/2012 | Castillo et al. | |
| 2012/0228419 | A1 | 9/2012 | Chen | |
| 2012/0246974 | A1 | 10/2012 | Hammerslag et al. | |
| 2013/0012856 | A1 | 1/2013 | Hammerslag et al. | |
| 2013/0014359 | A1 | 1/2013 | Chen | |
| 2013/0025100 | A1 | 1/2013 | Ha | |
| 2013/0091674 | A1 | 4/2013 | Chen | |
| 2013/0092780 | A1 | 4/2013 | Soderberg et al. | |
| 2013/0340283 | A1 | 12/2013 | Bell et al. | |

FOREIGN PATENT DOCUMENTS

| | | | |
|---|---|---|---|
| AT | 361808 | | 4/1981 |
| CA | 2114387 | | 1/1994 |
| CA | 2112789 | | 8/1994 |
| CH | 41765 | | 9/1907 |
| CH | 111341 | | 11/1925 |
| CH | 199766 | | 11/1938 |
| CH | 204 834 | A | 8/1939 |
| CH | 523 669 | | 7/1972 |
| CH | 562 015 | | 5/1975 |
| CH | 577 282 | | 7/1976 |
| CH | 612 076 | | 7/1979 |
| CH | 537 164 | | 7/1981 |
| CH | 624 001 | | 7/1981 |
| CH | 471 553 | | 12/1984 |
| DE | 555211 | | 7/1932 |
| DE | 641976 | | 2/1937 |
| DE | 1 661 668 | | 8/1953 |
| DE | 7043154.8 | | 11/1970 |
| DE | 1 785 220 | | 5/1971 |
| DE | 2 062 795 | | 6/1972 |
| DE | 23 41 658 | | 3/1974 |
| DE | 24 14 439 | | 10/1975 |
| DE | 29 00 077 | A1 | 7/1980 |
| DE | 2914280 | A1 | 10/1980 |
| DE | 31 01 952 | A1 | 9/1982 |
| DE | 36 26 837 | | 2/1988 |
| DE | 38 13 470 | | 11/1989 |
| DE | 3822113 | C2 | 1/1990 |
| DE | 9413147 | | 6/1994 |
| DE | 43 02 401 | A1 | 8/1994 |
| DE | 9315776 | | 2/1995 |
| DE | 29503552.8 | | 4/1995 |
| DE | 196 24 553 | | 1/1998 |
| DE | 19945045 | A1 | 9/1999 |
| DE | 201 16 755 | U1 | 1/2002 |
| EP | 0 056 953 81 | | 6/1969 |
| EP | 0 081 042 81 | | 7/1972 |
| EP | 0 123 050 | | 2/1984 |
| EP | 0 201 051 | | 11/1986 |
| EP | 0 099 504 | | 1/1987 |
| EP | 0 255 869 | | 7/1987 |
| EP | 0 155 596 | | 1/1988 |
| EP | 0 393 380 | | 3/1990 |
| EP | 0 651 954 | A1 | 4/1993 |
| EP | 0 474 708 | | 9/1993 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 679 346 | | 11/1995 |
| EP | 0 693 260 | B1 | 1/1996 |
| EP | 0 734 662 | A1 | 2/1996 |
| EP | 0 717 942 | | 6/1996 |
| EP | 0 858 619 | | 8/1996 |
| EP | 0 858 621 | | 8/1998 |
| EP | 0 923 965 | | 6/1999 |
| EP | 0 937 467 | | 8/1999 |
| EP | 0 848 917 81 | | 4/2000 |
| EP | 1 219 195 | | 2/2001 |
| EP | 1163860 | | 5/2001 |
| EP | 1 236 412 | A | 2/2002 |
| EP | 2359708 | | 8/2011 |
| FR | 1 349 832 | | 3/1963 |
| FR | 1 374 110 | | 11/1963 |
| FR | 1 404 799 | | 7/1964 |
| FR | 2 019 991 | A | 10/1969 |
| FR | 2 108 428 | | 9/1971 |
| FR | 2 173 451 | | 2/1972 |
| FR | 2 175 684 | | 3/1972 |
| FR | 2.108.429 | | 5/1972 |
| FR | 2 399 811 | | 9/1979 |
| FR | 2 565 795 | | 6/1984 |
| FR | 2 598 292 | A1 | 11/1987 |
| FR | 2 726 440 | A1 | 5/1996 |
| FR | 2 770 379 | A1 | 5/1997 |
| FR | 2 814 919 | A1 | 4/2002 |
| GB | 216400 | | 8/1923 |
| GB | 2 449 722 | A | 3/2006 |
| IT | 1220811 | | 3/1988 |
| JP | 49-28618 | | 3/1974 |
| JP | 51-2776 | | 1/1976 |
| JP | 51-121375 | | 10/1976 |
| JP | 53-124987 | | 3/1977 |
| JP | 54-108125 | | 2/1978 |
| JP | 62-57346 | | 4/1987 |
| JP | 63-80736 | | 5/1988 |
| JP | 6-284906 | | 11/1994 |
| JP | 7-000208 | | 6/1995 |
| JP | 3031760 | | 9/1996 |
| JP | 3030988 | | 11/1996 |
| JP | 8308608 | | 11/1996 |
| JP | 10-199366 | | 7/1998 |
| JP | 2001-197905 | | 7/2001 |
| JP | 2004-016732 | | 1/2004 |
| JP | 2004-041666 | | 2/2004 |
| KR | 20-0367882 | | 11/2004 |
| KR | 20-0400568 | | 8/2005 |
| KR | 10-0598627 | | 3/2006 |
| KR | 10-0953398 | | 4/2010 |
| KR | 10-1028468 | | 4/2011 |
| WO | WO 94/27456 | | 12/1994 |
| WO | WO 95/11602 | | 5/1995 |
| WO | WO 95/03720 | | 9/1995 |
| WO | WO 98/37782 | | 9/1998 |
| WO | WO 99/09850 | | 3/1999 |
| WO | WO 99/15043 | | 4/1999 |
| WO | WO 99/43231 | | 9/1999 |
| WO | WO 00/53045 | | 6/2000 |

(56) References Cited

FOREIGN PATENT DOCUMENTS

| | | | |
|---|---|---|---|
| WO | WO00/53045 | | 9/2000 |
| WO | WO 00/76337 | A1 | 12/2000 |
| WO | WO 01/08525 | | 2/2001 |
| WO | WO 02/051511 | | 7/2002 |
| WO | WO 2004/093569 | | 11/2004 |
| WO | WO/2007/016983 | | 2/2007 |
| WO | WO 2008/015214 | | 2/2008 |
| WO | WO/2015/035885 | | 3/2015 |

OTHER PUBLICATIONS

La Sportiva, A Technical Lightweight Double Boot for Cold Environments http://www.sportiva.com/products/footwear/mountain/spantik.

International Preliminary Report on Patentablilty for PCT/US2013/032326 mailed on Jun. 6, 2013. 6 pages.

* cited by examiner

GUIDES FOR LACING SYSTEMS

CROSS-REFERENCE TO RELATED APPLICATIONS

This application is a continuation of U.S. patent application Ser. No. 14/268,498, filed May 2, 2014, titled "GUIDES FOR LACING SYSTEMS," which is a continuation of U.S. patent application Ser. No. 13/011,707, filed Jan. 21, 2011, titled "GUIDES FOR LACING SYSTEMS," which claims the benefit under 35 U.S.C. §119(e) to U.S. Provisional Patent Application No. 61/297,023, filed Jan. 21, 2010, titled "GUIDES FOR LACING SYSTEMS," each of which is hereby incorporated by reference herein and made a part of this specification for all that it discloses.

INCORPORATION BY REFERENCE

The following references are hereby incorporated by reference herein in their entirety and made a part of the specification for all that they disclose: U.S. Pat. No. 7,591,050, filed Jun. 12, 2003, issued Sep. 22, 2009, and titled "FOOTWEAR LACING SYSTEM;" U.S. Patent Publication No. 2006/0156517, filed Oct. 31, 2005, and titled "REEL BASED CLOSURE SYSTEM;" U.S. Patent Publication No. 2010/0139057, filed Nov. 20, 2009, and titled "REEL BASED LACING SYSTEM;" U.S. Provisional Patent Application No. 61/297,023, filed Jan. 21, 2010, titled "GUIDES FOR LACING SYSTEMS;" and U.S. Provisional Patent Application No. 61/330,129, filed Apr. 30, 2010, and titled "REEL BASED LACING SYSTEM."

BACKGROUND

1. Field of the Disclosure

The present disclosure relates to lacing systems for use with wearable articles (e.g., footwear), and more particularly to guides for use with lacing systems.

2. Description of the Related Art

Although various lacing systems currently exist, there remains a need for improved guides for lacing systems.

SUMMARY OF THE INVENTION

A lacing system is disclosed. The lacing system can include an article having a tightening edge, a first lace guide element coupled to the tightening edge of the article, and a second lace guide element coupled to the tightening edge of the article. A lace can be threaded through the first and second lace guide elements such that a portion of the lace extending generally directly between the first and second lace guide elements is not directed away from the tightening edge of the article. The first and second lace guide elements can be angled towards each other.

In some embodiments, all turns in a lace path through the first and second lace guide elements can have a radius of curvature of at least about 1 mm during normal use. All turns in the lace path through the first and second lace guide elements can have a radius of curvature of at least about 2 mm during normal use. All turns in the lace path through the first and second lace guide elements can have a radius of curvature of at least about 5 mm during normal use. In some embodiments, the first and second lace guide elements can be configured to provide a lace path having at least one variable radius of curvature.

In some embodiments, the first lace guide element can have a first lace engagement location and a second lace engagement location, and the second lace guide element can have a third lace engagement location and a fourth lace engagement location. A first linear axis can pass through the first and second lace engagement locations, and a second linear axis can pass through the third and fourth lace engagement locations. When the first and second lace guide elements are in a substantially relaxed position, an angle formed between the first and second linear axes can be between about 95° and about 175°, between about 115° and about 155°, between about 130° and about 140°, or about 135°.

In some embodiments, the first lace guide element can be attached to the article and can extend along a first direction. The second lace guide element can be attached to the article and can extend along a second direction. The first and second lace guide elements can be angled towards each other such that an angle between the first and second directions can be between about 5° and about 85°, between about 25° and about 65°, between about 40° and about 50°, or about 45°.

In some embodiments, at least one of the first and second lace guide elements is a flexible webbing. The flexible webbing can have a first end attached to the article near the tightening edge at a first location and a second end attached to the article at substantially the first location such that the flexible webbing forms a loop at the first location.

The flexible webbing can have a loop formed at an end of the flexible webbing, the loop having first and second openings, and the first opening can form the first lace engagement location and the second opening can form the second lace engagement location. A strap portion can extend from the loop, and the strap portion can be attached to the article. A belt-loop member can be configured to receive the strap and maintain the strap in a predetermined region, and the belt-loop member can be larger than the strap to allow the strap to shift substantially unimpeded by the belt-loop member during normal use of the article.

The flexible webbing can include a first end attached to the article at a first location and a second end attached to the article at a second location. A strap can extend between the first and second locations and the strap can be longer than the distance between the first and second locations such that the strap provides a lace path through the strap at a third location that is on an opposite side of the tightening edge than the first and second locations.

A lacing system is disclosed. The lacing system can include an article having a first side and a second side generally opposing the first side such that the first and second sides are configured to be drawn together to tighten the article and moved apart to loosen article, a lace, and a lace guide. The lace guide can have a first lace guide element coupled to the first side of the article. The first lace guide element can be configured to receive the lace at a first lace engagement location and to permit the lace to exit at a second lace engagement location. The first lace engagement location can be positioned closer to the second side of the article than is the second lace engagement position. The lace guide can have a second lace guide element coupled to the first side of the article. The second lace guide element can be configured to receive the lace at a third lace engagement location and to permit the lace to exit at a fourth lace engagement location. The fourth lace engagement location can be positioned closer to the second side of the article than is the third lace engagement location.

In some embodiments, the lace can extend from the second side of the article to the first lace engagement location, can enter the first lace guide element through the first lace engagement location, can extend through the first lace guide element, can exit the first lace guide element through the second lace engagement location, can pass between the first and second lace guide elements on the first side of the article without extending towards the second side of the article, can enter the second lace guide element through the third lace engagement location, can extend through the second lace guide element, can exit the second lace guide element through the fourth lace engagement location, and can extend from the second lace engagement location toward the second side of the article.

The first lace engagement location, the second lace engagement location, the third lace engagement location, and the fourth lace engagement location can each provide a lace path having a radius of curvature of at least about 1 mm, or of at least about 2 mm, or of at least about 5 mm, during normal use. The first lace engagement location, the second lace engagement location, the third lace engagement location, and the fourth lace engagement location can each be configured to provide a lace path having variable radius of curvature.

A first linear axis can pass through the first and second lace engagement locations, and a second linear axis can pass through the third and fourth lace engagement locations. When the first and second lace guide elements are in a substantially relaxed position, an angle formed between the first and second linear axes can be between about 95° and about 175°, between about 115° and about 155°, between about 130° and about 140°, or can be about 135°.

The first lace guide element can be attached to the first side of the article and can extend along a first direction generally toward the second side of the article, the second lace guide element can be attached to the first side of the article and can extend along a second direction generally toward the second side of the article. The first and second lace guide elements can be angled towards each other such that an angle between the first and second directions is between about 5° and about 85°, is between about 25° and about 65°, is between about 40° and about 50°, or is about 45°.

The first lace guide element can be a flexible webbing. The flexible webbing can have a loop formed at an end of the flexible webbing nearest the second side of the article. The loop can have first and second openings, and the first lace engagement location can be at the end of the first opening closest to the second side of the article, and the second lace engagement location can be at the end of the second opening closest to the second side of the article. A strap portion can extend from the loop generally away from the second side of the article, and the strap portion can be attached to the first side of the article. A belt-loop member can be configured to receive the strap and maintain the strap in a predetermined region. The belt-loop can be larger than the strap to allow the strap to shift substantially unimpeded by the belt-loop during normal use of the article.

The flexible webbing can have a first end attached to the first side of the article at a first location, and a second end attached to the first side of the article at substantially the first location such that the flexible webbing forms a loop at the first location.

The flexible webbing can have a first end attached to the first side of the article at a first location, a second end attached to the first side of the article at a second location, and a strap extending between the first and second locations. The strap can be longer than the distance between the first and second locations such that the strap provides a lace path through the strap at a third location that is closer to the second side of the article than both the first and second locations.

A lace guide is disclosed. The lace guide can include a first end region having a first opening to allow a lace to enter the lace guide, a second end region having a second opening to allow the lace to exit the lace guide, and a center region between the first end and the second end. The first end region and the second end region can be more flexible than the center region such that the first end region and the second end region can be configured to deform more than the center region when the lace is tightened.

The center region can include a first material and the first and second end regions can include a second material, and the second material can be more flexible than the first material. The first material and the second material can be woven materials, and the first material can be woven more densely than the second material.

The first end region, the second end region, and the center region can include a flexible webbing, and the center region can include an additional layer over the flexible webbing to reduce the flexibility of the center region.

The first end region and the second end region can provide curved lace paths having a radius of curvature of at least about 1 mm, or of at least about 2 mm, or of at least about 5 mm during normal use. The center region can provide a substantially linear lace path between the first end region and the second end region. In some embodiments, the first and second end regions can be configured to each provide a lace path having a variable radius of curvature.

BRIEF DESCRIPTION OF THE DRAWINGS

Certain embodiments will now be discussed in detail with reference to the following figures. These figures are provided for illustrative purposes only, and the inventions are not limited to the subject matter illustrated in the figures.

DETAILED DESCRIPTION OF THE PREFERRED EMBODIMENT

Figure 1:
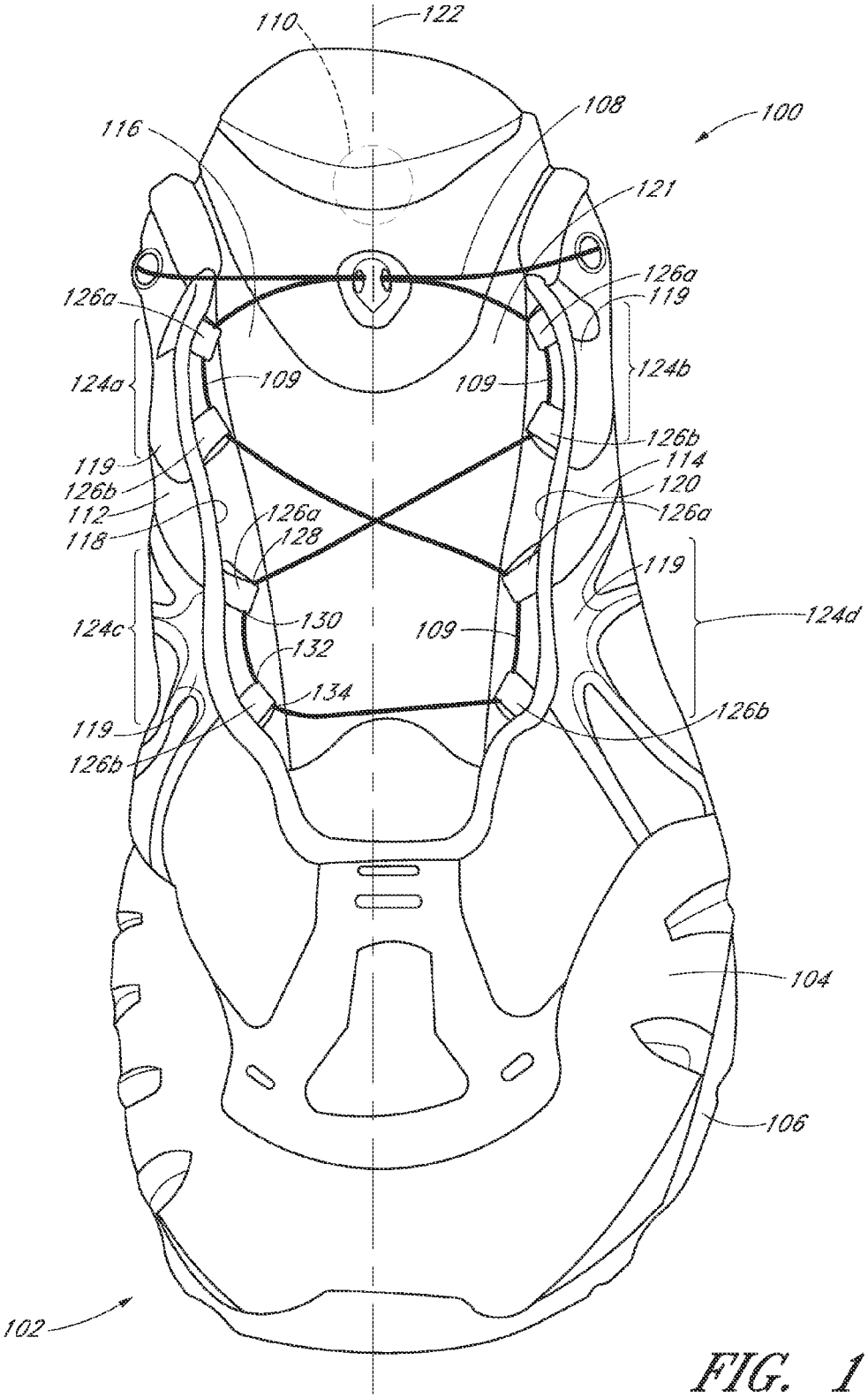
FIG. 1 is an example embodiment of a lacing system incorporated into a shoe.

FIG. 1 illustrates an example embodiment of a lacing system 100 integrated into a shoe 102. Although various embodiments disclosed herein are discussed in the context of tightening a shoe or other footwear article, the lacing systems disclosed herein may be used with various other objects, including but not limited to gloves, hats, belts, braces, boots, or various other wearable articles. In the illustrated embodiment, the shoe 102 can include an upper 104 jointed to a sole 106. The upper 104 can include a first side 112 and a second side 114 generally opposing the first side 112, and the lacing system 100 can be configured to draw the first side 112 and the second side 114 together, thereby tightening the shoe 102 around the wearer's foot. The first side 112 can include a first tightening edge 118, the second side 114 can include a second tightening edge 120, and a gap 121 can be formed therebetween. In some embodiments, the shoe 102 can include a tongue 116, generally positioned in the gap 121 between the first and second tightening edges 118, 120. As the lacing system 100 is tightened, the first and second tightening edges 118, 120 can be drawn towards each other thereby reducing the distance of the gap 121 therebetween, and as the lacing system 100 is loosened, the first and second tightening edges 118, 120 can move away from each other thereby increasing the gap 121 distance therebetween. The first and second tightening edges 118, 120 of the shoe 102 can be generally equally spaced on either side of a midline 122 that extends along the longitudinal axis of the shoe 102. Although the embodiment illustrated in FIG. 1 shows that lacing system generally centered along the midline 122 of the shoe 102, in other embodiments, the lacing system 100 can be configured to tighten and loosen an opening on any other suitable portion of an article, such as a side opening located on a side of a shoe that is not generally centered on the longitudinal axis of the shoe 102. Thus, in some embodiments, the first side 112 of the shoe 102 can cover significantly more area of the shoe 102 than does the second side 114, or significantly less area of the shoe 102 than does the second side 114.

The lacing system 100 can include a lace 108. Various lace types can be used, including but not limited to stranded steel cable with no coating, stranded steel cable with a polymer coating (e.g., nylon coating), monofilament (e.g., nylon), or braided Spectra®. In some embodiments, standard conventional shoe laces can be used for the lace 108. The lace 108 can have a diameter of at least about 0.015 inches and/or no more than about 0.1 inches, although diameters outside these ranges can also be used. In some embodiments the lace 108 can have a diameter of about 0.032 inches.

The lacing system 100 can include a mechanism for imparting and/or holding tension on the lace 108. For example, the lacing system 100 can include a lace winder 110 mounted on the shoe 102 (e.g., on the heel). Although in the embodiment illustrated in FIG. 1 the lace winder 110 is mounted onto the heel of the shoe 102 (shown in dotted lines), the lace winder 110 can be mounted onto the tongue 116 of the shoe 102, or onto the upper 104 (e.g., on the side of the shoe 102), or to any other suitable location that allows the lace to be fed into and out of the lace winder 110. The lace winder can include a spool rotatably mounted in a housing such that rotation of the spool causes the lace to be gathered into or released from the housing. A knob can be coupled to the spool to allow the user to tightening and/or loosening the lace 108. Many lace widers may be used with advantageous results. For example, one or more of the lace winders disclosed in U.S. Pat. No. 7,591,050, filed Jun. 12, 2003, issued Sep. 22, 2009, and titled "FOOTWEAR LACING SYSTEM;" U.S. Patent Publication No. 2006/0156517, filed Oct. 31, 2005, and titled "REEL BASED CLOSURE SYSTEM;" U.S. Patent Publication No. 2010/0139057, filed Nov. 20, 2009, and titled "REEL BASED LACING SYSTEM;" and U.S. Provisional Patent Application No. 61/330,129, filed Apr. 30, 2010, and titled "REEL BASED LACING SYSTEM" could be used, the entire disclosures of each of which are hereby incorporated by reference herein in their entirety and made a part of this specification for all that they disclose. In some embodiments, the lacing system 100 can include more than one lace winder 110 and/or more than one lace 108, for example if the article includes multiple lacing zones. In some embodiments, the lacing system does not include a lace winder 110. For example, the lace can be permanently secured to the shoe 102, or lace tension can be maintained using a knot or in any other suitable manner. In some embodiments, the lace winder may not be manually tightened. Rather, it may automatically take up slack via a spring or other similar means as disclosed, for example, in U.S. Pat. No. 7,591,050, filed Jun. 12, 2003, issued Sep. 22, 2009, and titled "FOOTWEAR LACING SYSTEM" and/or U.S. Patent Publication No. 2006/0156517, filed Oct. 31, 2005, and titled "REEL BASED CLOSURE SYSTEM."

The lacing system 100 also includes one or more lace guides 124 configured to guide the lace 108 through the lacing system 100. The lace guides 124 can be coupled to the first and second sides 112, 114 (e.g., to the first and second tightening edges 118, 120) so that the first and second sides 112, 114 of the shoe 102 are drawn together when the lace 108 is tightened, for example, by the lace winder 110. One or more of the lace guides 124 can be low-friction lace guides configured to substantially evenly distribute the force imposed by the tightened lace 108, thereby reducing pressure points which can cause discomfort and impaired performance. The low-friction lace guides 124 can allow the lace 108 to shift position during use so as to provide a dynamic fit.

In some embodiments, one or more of the lace guides 124 can be configured to reduce the occurrence of sharp corners in the lace 108. For example, in some embodiments, the lace guides 124 can provide a lace path that causes the lace to have a radius of curvature during normal use of at least about 1 mm, at least about 2 mm, at least about 3 mm, at least about 5 mm, at least about 7 mm, at least about 10 mm, no more than about 15 mm, no more than about 10 mm, no more than about 7 mm, and/or no more than about 5 mm, although radii of curvature outside these ranges are also possible. In some embodiments, the entire lace path through the lacing system 100 can be configured to not have sharp turns (e.g., of less than a 1 mm, 2 mm, 3 mm, 5 mm, 7 mm, or 10 mm radius of curvature) during normal use. In some embodiments, at least one of the lace guides 124 provides a lace path having a radius of curvature of at least about 1 mm, 2 mm, 3 mm, 5 mm, 7 mm, or 10 mm during normal use, even if the lace path includes one or more sharp turns at other locations. In some embodiments, the lace guides 124 can provide a lace path having a variable radius of curvature that depends on the tension applied to the lace 108. "Normal use" as used herein is meant to refer to situations where the article is tightened to a tension that one would generally expect during use of the particular article.

The reduction or elimination of sharp turns from the lace path can prevent lace fatigue and can reduce the friction and wear on lace 108 and on the guides 124, thereby providing a lacing system that is more reliable and more durable. Reducing or removing sharp turns from the lace path can be increasingly advantageous in embodiments where laces of smaller diameters, and harder, less flexible, materials are used. In some embodiments, harder and less flexible laces (e.g., steel cable laces) can allow for increased tension to be applied to the lacing system. The lacing system 100 can be configured to tighten with about 2.5 pounds of force in some embodiments, although a much higher tension of up to about 30 pounds can be used in some embodiments (e.g., snowboard boots). When the force is concentrated on a smaller lace thickness, and the force is not significantly absorbed by a softer lace material, and the force is not significantly absorbed by stretching of the lace, it can be particularly advantageous to avoid sharp turns in the lace path.

As shown in FIG. 1, in some embodiments, one or more of the lace guides 124 can include multiple (e.g., a pair) of lace guide elements 126*a-b*. The embodiment illustrated in FIG. 1 has four lace guides 124*a-d* that have pairs of lace guide element 126*a-b*, but other numbers of lace guide element pair guides can be used. For example, additional lace guide element pairs can be used for shoes designed for activities in which high lateral stability is desirable (e.g., tennis shoes). In some embodiments, a shoe can include six lace guides that include lace guide element pairs, resulting in one additional lace crossing than in the embodiment shown in FIG. 1. For shoes having a large closure area (e.g., high-top shoes or boots), 6, 8, 10 or more lace guides can be used depending on the size of the closure area and the desired support level. Also in some embodiments a lace guide can have more than two lace guide elements. For example, a third lace guide element can be placed between the first and second lace guide elements 126*a-b*.

The lace 108 can pass through multiple (e.g., two) consecutive lace guide elements 126*a-b* on one side of the shoe 102. The lace path through the lace guide 124*c* will be described, and the other lace guide pairs can have similar lace paths. The lace path can lead through the first and second lace guide elements 126*a*, 126*b* positioned on the first side 112 of the shoe 102 without passing to the second side 114 therebetween. The lace 108 can lead to the first lace guide element 126*a* from the second side 114 of the shoe 102. The lace guide element 126*a* can receive the lace 108 at a first lace engagement location 128. The lace 108 can extend through the first lace guide element 126*a* and exit the first lace guide element 126*a* at the second lace engagement location 130. The lace 108 can pass from the first lace guide element 126*a* to the second lace guide element 126*b* without returning to the second side 114 of the shoe 102 between the first and second lace guide elements 126*a-b*. The second lace guide element 126*b* can receive the lace 108 at a third lace engagement location 132. The lace 108 can extend through the second lace guide element 126*b*, and the lace 108 can exit the second lace guide element 126*b* at a fourth lace engagement location 134. From the fourth lace engagement location 134, the lace 108 can extend toward the second side 114 of the shoe 102. Thus, although the lace guide element 126*a* can be separately formed from the lace guide element 126*b*, the lace guide elements 126*a*, 126*b* can function as a single lace guide 124 (e.g., guiding the lace from the second side 114 to the first side 112 and then back toward the second side 114 of the shoe 102).

Because the first lace guide elements 126*a* are spaced apart from the second lace guide elements 126*b*, and because the lace 108 is threaded directly from the first lace guide element 126*a* to the second lace guide element 126*b* on the same side of the article, the tension from the lace 108 can be adequately distributed across the tightening edges 118, 120 using fewer lace crossings than if the lace 108 were crossed between the sides 112, 114 of the shoe 102 after each individual lace guide element 126. Thus, the lace path leading through consecutive lace guide elements 126 on one side of the shoe can result in a reduced lace length. Also, the lacing system 100 can be tightened by taking up less lace than would be required for a lacing system having more lace crossings, thereby allowing the use of a smaller size of lace winder 110 and/or allowing the lacing system 100 to be tightened using less rotation and less time. Fewer lace crossings and a reduced lace length also can result in reduced friction, thereby reducing the force required for tightening or loosening the lacing system 100 and allowing for a dynamic fit in which the lace 108 is permitted to adjust during use.

The radius of curvature that the lace 108 experiences as it passes through the lace guide elements 126*a-b* depends on the angles of the turns in the lace path. The radius of curvature is also influenced several other factors, such as the flexibility of the material of the lace guide elements 126*a-b*, the rigidity of the lace 108, and the tension applied to the lace 108. The lace guide elements 126*a-b* can be angled towards each other to reduce the turning angles applied to the lace 108 as it passes through the lace guide elements 126*a-b*. As the lace 108 passes from the second side 114 of the article to the first side 112 of the article and then back to the second side 114, the lace 108 may undergo a large total turning angle, for example, of at least about 75° and/or less than or equal to about 215°. The first lace guide element 126*a* can turn the lace 108 for a portion (e.g., approximately half) of the total turning angle, and the second lace guide element 126*b* can turn the lace 108 for another portion (e.g., approximately half) of the total turning angle. Thus, the lace guide elements 126*a-b* can reduce the turning angle that is experienced by any particular location on the lace path by dividing the turning angle among multiple locations.

Figure 2B:
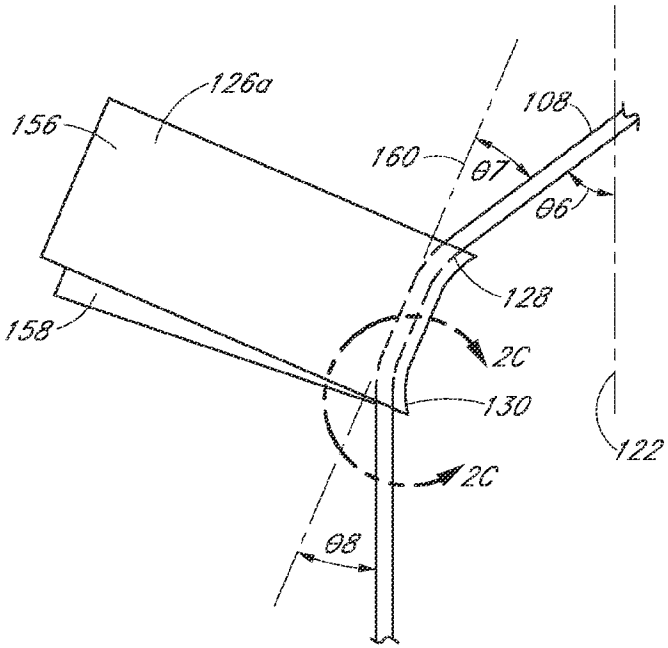
FIG. 2B illustrates one of the lace guide elements of FIG. 2A with a lace applying tension thereto.
Figure 2A:
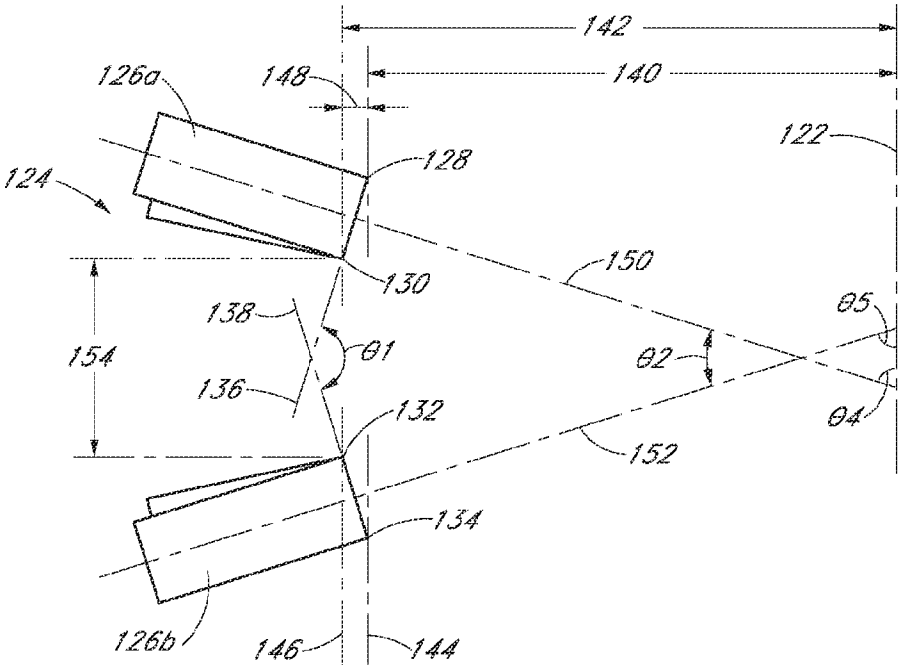
FIG. 2A illustrates two lace guide elements from the lacing system of FIG. 1.

With reference to FIG. 2A, an example embodiment of a lace guide 124 is shown, which can be, for example, one of the lace guides 124*a-d* of FIG. 1. The lace guide 124 can include a first lace guide element 126*a* and a second lace guide element 126*b*. A linear axis 136 can pass through the first lace engagement location 128 and the second lace engagement location 130, and the axis 136 can generally align parallel to the direction of the lace path through the central portion of the first lace guide element 126*a*. A linear axis 138 can pass through the third lace engagement location 132 and the fourth lace engagement location 134, and the axis 138 can generally align parallel to the direction of the lace path through the control portion of the second lace guide element 126*b*. An angle θ1 can be formed between the axis 136 and the axis 138 can be about 95° and/or less than or equal to about 175°, or θ1 can be at least about 115° and/or less than or equal to about 155°, or θ1 can be at least about 130° and/or less than or equal to about 140°, or θ1 can be about 135°, although angles outside these ranges may be used in some embodiments. In FIG. 2A the lace 108 is omitted from view and the lace guide elements 126*a-b* are shown in a substantially relaxed position in which the positions of the lace guide elements 126*a-b* are not modified by tension applied by the lace 108. In some embodiments, at tension is applied by the lace 108, the positions of the lace guide elements 126*a-b* can remain substantially unmodified, while in other embodiments the tension can change the positions of the lace guide elements 126*a-b* (e.g., pulling the lace guide elements 126*a-b* towards each other).

The first lace engagement location 128 can be positioned closer to the midline 122, or to the opposing side 114, than is the second lace engagement location 130, such that the lace 108 (not shown in FIG. 2A) enters the first lace guide element 126*a* from the opposing side 114 (not shown in FIG. 2A) at a location that is closer to the midline 122, or to the opposing side 114, than is the location where the lace 108 exits the first lace guide element 126*a* at the second lace engagement location 130. In some embodiments, the distance 140 between the first lace engagement location 128 and the midline 122, or to the opposing side 114, can be less than the distance 142 between the second lace engagement location 130 and the midline 122, or the opposite side 114.

Similarly, the second lace guide element 126*b* can have a third lace engagement location 132 to receive the lace 108 from the first lace guide element 126*a*, and a fourth lace engagement location 134 to direct the lace 108 back towards the opposing side 114, or to the midline 122. The fourth lace engagement location 134 can be positioned closer to the opposing side 114, or to the midline 122, than is the third lace engagement location 132, such that the lace 108 exits the second lace guide 126*b* toward the opposing side at a location that is closer to the opposing side (e.g., second side 114) than is the location where the lace 108 enters the third lace engagement location 130. In some embodiments, the distance 140 between the fourth opening 132 and the midline 122, or to the opposite side 114, can be less than the distance 142 between the first opening 130 and the midline 122, or to the opposite side 114. Thus, the second lace guide element 124*b* can provide a lace path into, through, and out of the second lace guide element 124*b* that had a radius of curvature of at least about 1 mm, at least about 2 mm, at least about 3 mm, at least about 5 mm, at least about 7 mm, or at least about 10 mm.

In some embodiments, an axis 144 drawn through the first lace engagement location 128 and the fourth lace engagement location 134 can be substantially parallel with an axis 146 drawn through the second lace engagement location 130 and the third lace engagement location 132. In some embodiment one or both of the axes 144, 146 can be generally parallel to the midline 122. In some embodiments, the distance 148 between the axis 144 and the axis 146 can be at least about 4 mm and/or at least about 8 mm, or it can be about 6 mm, although other values can also be used.

In some embodiments, the first lace guide element 126*a* can attach to the first side 112 of the shoe 102 and can extend generally towards the opposite side 114, or towards the midline 122, of the shoe 102 along an axis 150. The second lace guide element 126*d* can attach to the first side 112 of the shoe 102 and can extend generally towards the second side 114, or the midline 122, of the shoe 102 along a axis 152. The first and second lace guide elements 126*a*, 126*b* can be angled towards each other such that the angle θ2 between the axis 150 and the axis 152 can be at least about 5° and/or less than or equal to about 85°, or θ2 can be at least about 25° and/or less than or equal to about 65°, or θ2 can be at least about 40° and/or less than or equal to about 50°, or θ2 can be about 45°, although angles outside these ranges may also be used in some embodiments. In some embodiments, the first lace guide element 126*a* can be angled with respect to the midline 122 such that an angle θ4 formed between the axis 150 along which the lace guide element 126*a* extends and the midline 122 can be greater than about 47.5° and/or less than about 87.5°, or θ4 can be at least about 57.5° and/or less than or equal to about 77.5°, or θ4 can be at least about 65° and/or less than or equal to about 70°, or θ4 can be at about 67.5°, although angles outside these ranges can also be used. In some embodiments, the corresponding lace guide element 126*b* can be angled with respect to the midline 122 by an angle θ5 in an opposite direction but by substantially the same amount as the angle θ4. In some embodiments, the lace guide elements 126*a-b* are substantially symmetrical, for example, across a line transverse to the midline 122. In some embodiments, the lace guide elements 126*a-b* are not substantially symmetrical.

In some embodiments, one or more of the lace guide elements 126*a* can be angled away from the adjacent lace guide element (not shown in FIG. 2A) of the neighboring lace guide on the same side 112 of the shoe 102 such that an angle θ3 between the direction 150 along which the lace guide element 126*a* extends and the direction (not shown) along which the adjacent lace guide element extends can be at least about 5° and/or less than or equal to about 85°, or θ2 can be at least about 25° and/or less than or equal to about 65°, or θ2 can be at least about 40° and/or less than or equal to about 50°, or θ2 can be about 45°, although angles outside these ranges may also be used in some embodiments.

The first and second lace guide elements 126*a-b* can be positioned on the first side 112 of the shoe 102 and can be spaced apart by a distance 154. The distance 154 can be taken between the second lace engagement location 130 and the third lace engagement location 132 and can be generally equal to the length of the lace path extending directly between the two lace guide elements 126*a-b*. The distance 154 can be at least about 2 mm long and/or less than or equal to about 30 mm long, although values outside these ranges can be used. In some cases a distance 154 of 20 mm can be used to separate the lace guide elements 126*a-b*. With reference back to FIG. 1, because the lace guide elements 126 are spaced apart, tension applied by the longitudinal extensions 109 of the lace 108 between adjacent lace guide elements 126*a-b* can cause the tightening edges 118, 120 or other portions of the upper 104 to buckle, thereby unintentionally drawing the two adjacent lace guide elements 126 together. To reduce the occurrence of buckling, the shoe 102 can include stiffeners 119, which can be rigid or semi-rigid pieces of plastic, or thicker portions of the upper 104 itself. The stiffeners 119 can be positioned between adjacent lace guide elements 126*a-b* where the longitudinal extensions 109 of the lace 108 reside.

With reference now to FIG. 2B a lace guide element 126*a* is shown, and the other lace guide elements 126 can be similar to the lace guide element 126*a* shown in FIG. 2B. The lace guide element 126*a* can be formed from a piece of webbing that is folded over to create a loop. The webbing can be a woven material made of polyester, nylon, Teflon, polyurethane strands, or any other suitable material. The lace guide element 126*a* can be folded generally transverse to the longitudinal axis of the webbing strip such that a top layer 156 is disposed generally directly over a bottom layer 158 of the webbing loop forming the lace guide element. The webbing strip can also be folded at an angle that is not transverse to the longitudinal axis of the webbing strip so that the top layer 156 and bottom layer 158 of the webbing loop extend at different angles.

The lace 108 can approach the first lace engagement location 128 at the top of the lace guide element 126*a* from the opposing side 114 along a first generally linear direction, which can be, in some embodiments, at a non-orthogonal angle to the midline 122. For example, if the previously engaged lace guide element (not shown in FIG. 2B) is attached to the opposing side 114 of the shoe 102 at a location higher on the shoe, the lace 108 can approach the lace guide element 126*a* at an angle. The angle θ6 between the midline 122 and the lace path approaching the first lace engagement location 128 of the lace guide element 126*a* can be at least about 45° and/or less than or equal to 75°, or the angle can be about 60°, although other angles can be used. For example, if the lace path approaching the first lace engagement location 128 at an angle orthogonal to the midline 122, the lace guide element 126*a* can be angled more sharply inward (e.g., decreasing the angle θ1, increasing the angle θ2) to compensate for the additional turning of the lace 108 through the lace guide element 126*a*. An axis 160 can extend through the portion of the lace path that passes through the central portion of the lace guide element 126*a*. An angle θ7 formed between the direction of the lace path approaching the first lace engagement location 128 and the axis 160 can be at least about 15° and/or less than or equal to 45°, or the angle can be about 30°, although angles outside these range may also be used.

The lace 108 can leave the second lace engagement location 130 and extend along a lace path toward the next lace guide element 114 that can be substantially parallel to the midline 122, or at any other suitable angle. An angle θ8 formed between the axis 160 and the exit lace path extending between the first lace guide element 126*a* and the second lace guide element 126*b* can be at least about 15° and/or less than or equal to 45°, or θ8 can be about 30°, although angles outside these range may also be used. Although FIG. 2B does not specifically illustrate the second lace guide element 126*b*, the lace path can be similar to that of the first lace guide element 126*a*. The lace path through the lace guide element 126*a* can be configured to substantially linear at it approaches the first lace engagement location 128, curved at the first lace engagement location 128, substantially linear at a central portion of the lace guide element 126*a*, curved at the second lace engagement location 130, and substantially linear at the portion extending towards the second lace guide element. The second lace guide element 126*b* can be similarly configured. In some embodiments, the lace guide elements 126*a-b* can be configured to provide a single curved lace path section through the lace guide element 126*a*. For example, a soft material can be used for the lace guide elements 126*a-b* that allows more flexibility and provides a continuous curved lace path through the lace guide elements. A woven material can be used, and the tightness of the weave and the number of yarns can be adjusted to provide the desired level of flexibility.

Figure 2D:
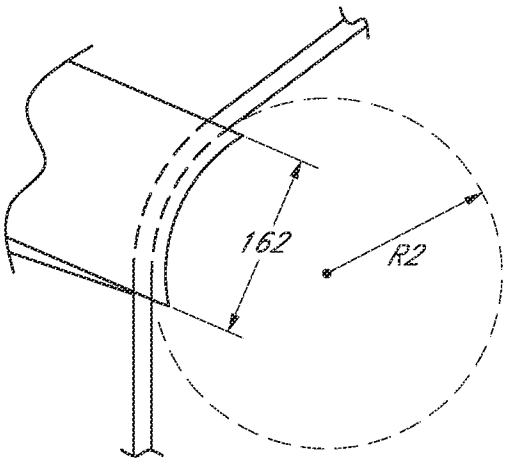
FIG. 2D is another example embodiment of an lace guide element with a lace applying tension thereto.
Figure 2C:
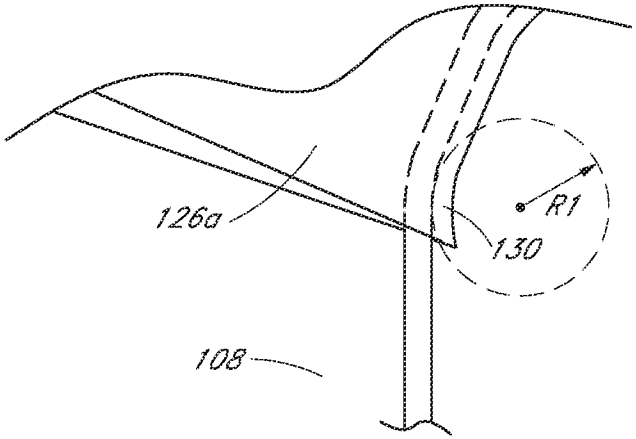
FIG. 2C is a close-up view of an lace engagement location on the lace guide element of FIG. 2B.

FIG. 2C is a close-up, detailed view of lace guide element 126*a*. The curved portion of the lace path at the second lace engagement location 130 can have a radius of curvature R1 of at least about 1 mm, 2 mm, 3 mm, 5 mm, 7 mm, or 10 mm during normal use, although other values outside these ranges can also be used. The first lace engagement location 128, the third lace engagement location 132, and/or the fourth lace engagement location 134 can similarly have curved lace path portions associated therewith that have a radius of curvature of at least about 1 mm, 2 mm, 3 mm, 5 mm, 7 mm, or 10 mm during normal use. In some embodiments, one or more of the lace engagement locations 128, 130, 132, and 134 can be configured to provide a variable radius of curvature that changes depending on the tension applied by the lace 108. In some embodiments, the lace guide elements can have outside portions that are more flexible than the center portion thereby facilitating the shape of the lace path shown in FIG. 2C. In some embodiments, one or more of the lace engagement locations 128, 130, 132, and 134 can have a permanent curved shaped that provides a fixed radius of curvature.

FIG. 2D is a close-up, detailed view of another embodiment of a lace guide similar to that shown in FIG. 2C; however, in the embodiment of FIG. 2D, the lace guide element 126*a* creates a continuously curved pathway through the lace guide element. The continuously curved pathway can have a radius of curvature R2 of at least about 1 mm, 2 mm, 3 mm, 5 mm, 7 mm, or 10 mm during normal use. Also shown in FIG. 2D, the lace guide elements can have a width 162 that is at least about 4 mm and/or less than or equal to about 10 mm, or the width 162 can be at least about 6 mm and/or less than or equal to about 8 mm, although other sizes can also be used. Because the lace guide elements 126*a-b* are used in pairs, each lace guide element 126*a-b* can have a smaller width than traditional single piece lace guides. In some cases, the smaller width of the generally flexible webbing guide elements 126*a-b* can prevent buckling that may occur flexible lace guides of larger widths. The width 162 of the lace guide elements 126*a-b* can be large enough to allow the lace guide elements 126*a-b* to deform to provide a lace path that does not turn sharp corners, while also being narrow enough to resist buckling.

Figure 3A:
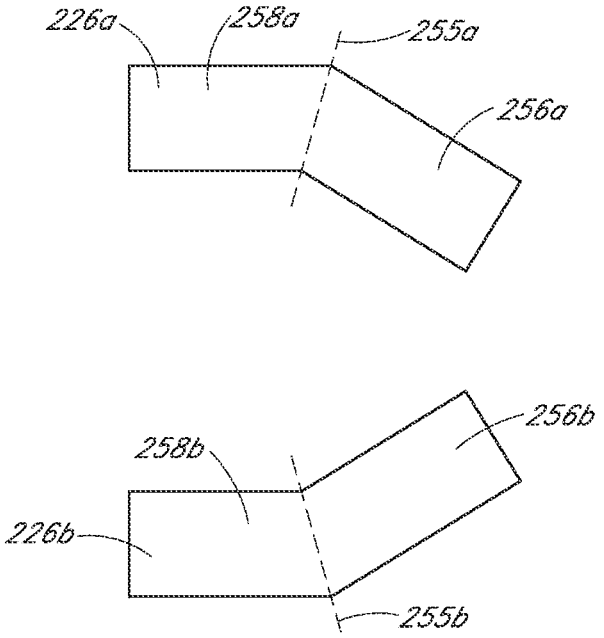
FIG. 3A is a example embodiment of a pair of lace guide elements in an unassembled configuration.
Figure 3B:
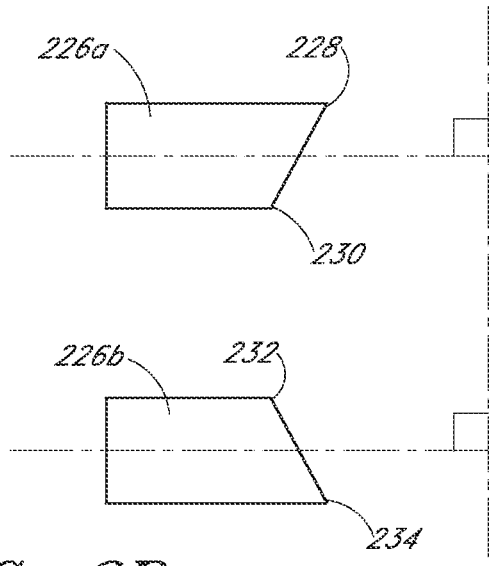
FIG. 3B is an example embodiment of the pair of lace guide elements in an assembled configuration.

In the embodiment illustrated in FIG. 1, each of the lace guide elements 126*a-b* extend generally toward the midline 112 at an angle respect to the midline 122 in alternating opposite directions, as discussed above. However, as shown in FIGS. 3A-B, in some embodiments, one or more of the lace guide elements 226*a-b* can extend substantially directly toward the midline 222 or substantially directly toward the opposing side of the shoe. FIG. 3A shows two lace guide elements 226*a-b* in an unassembled configuration. The webbing loop can be formed by folding a V-shaped strip of webbing at an axis 255*a-b* that crosses through the apex of the V-shape. Thus, once folded, the top layers 256*a* can be positioned over bottom layers 258*a-b*, thereby forming a webbing loop that can extend substantially directly toward the opposing side of the shoe, or toward the midline 222, while also providing a first lace engagement location 228 that is closer to the opposing side, or to the midline 222, than is the second lace engagement location 230, and a fourth lace engagement location 234 that is closer to the opposing side, or to the midline 222, than is the third lace engagement location 232.

Returning now to FIG. 1, the lace guide elements 126*a-b* can be attached to the shoe 102 in any suitable manner, including but not limited to using stitching, adhesives, and/or rivets. In FIG. 1, the outside ends of the top layer 15 and the bottom layer 158 of the lace guide elements 126*a-b* can be coupled to an underside of the an upper layer at the tightening edges 118, 120. In some embodiments, one or more lines of stitching can be applied through the top and bottom layers 156, 158 and into the upper 104 of the shoe 102 to secure the lace guide elements 126*a-b* thereto.

Figure 4A:
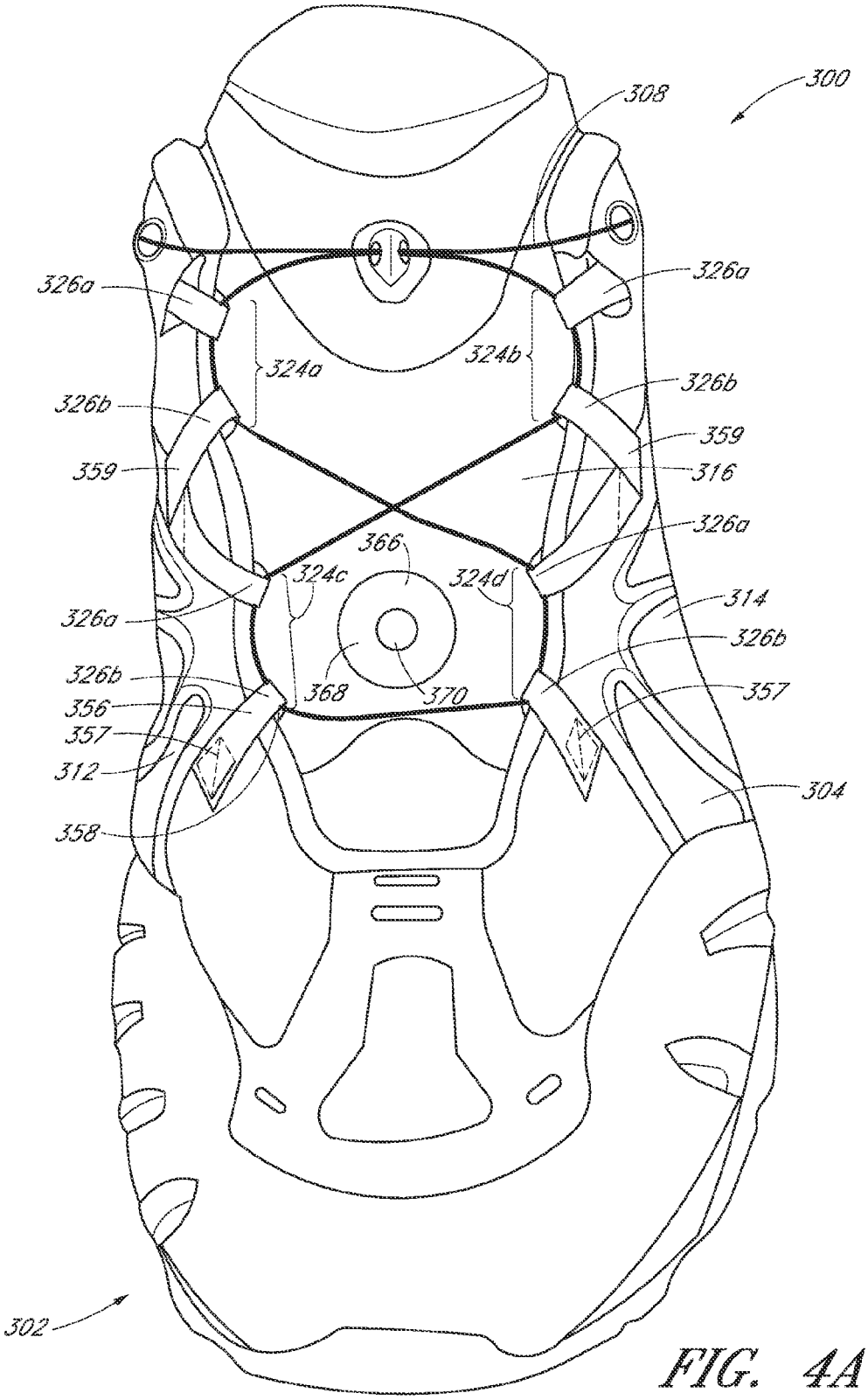
FIG. 4A is another example embodiment of a lacing system integrated into a shoe having a power zone mechanism in an unengaged configuration.

FIG. 4A illustrates another example embodiment of a lacing system 300 incorporated into a shoe 302. The shoe 302, lace 308, and the lace winder 310 can be the same as, or similar to, the shoe 102, lace 108, and lace winder 110 described herein. The lace guides 324*a-d* can be similar to the lace guides 125*a-d* in some regards. The lace guides 324*a-d* can include pairs of lace guide elements 326*a-b*. The lace guide elements 326*a-b* can be angled together similarly as discussed in connection with the other lace guide elements 126*a-b* discussed herein. Also, the lace 308 can be laced through the lace guide elements 326*a-b* similarly as discussed in connection with FIG. 1.

In the embodiment illustrated in FIG. 4A, the lace guide elements 326*a-b* can be coupled to the sides 312, 314 by attaching (e.g., by stitching, or an adhesive, or any other suitable manner) the top layers 256 of the lace guide elements 226*a-b* to an outer surface of the upper 204, and by attaching (e.g., by stitching, or an adhesive, or any other suitable manner) the bottom layers 358 of the lace guide elements 326*a-b* to an underside of the upper 304. The upper layers 356 can extend partially down the outer surface of the upper 304 to the coupling location 357 where the upper layers 356 of the lace guide elements 326*a-b* are secured to the upper 304. In the illustrated embodiment, a box stitch is used and can extend through the upper to also couple the bottom layers 358 to the upper 304 as well. In some embodiments, multiple lace guide elements 326*a-b* can share a common connection location 359 and a common stitching box or line can be used to secure multiple lace guide elements 326*a-b*.

Figure 4B:
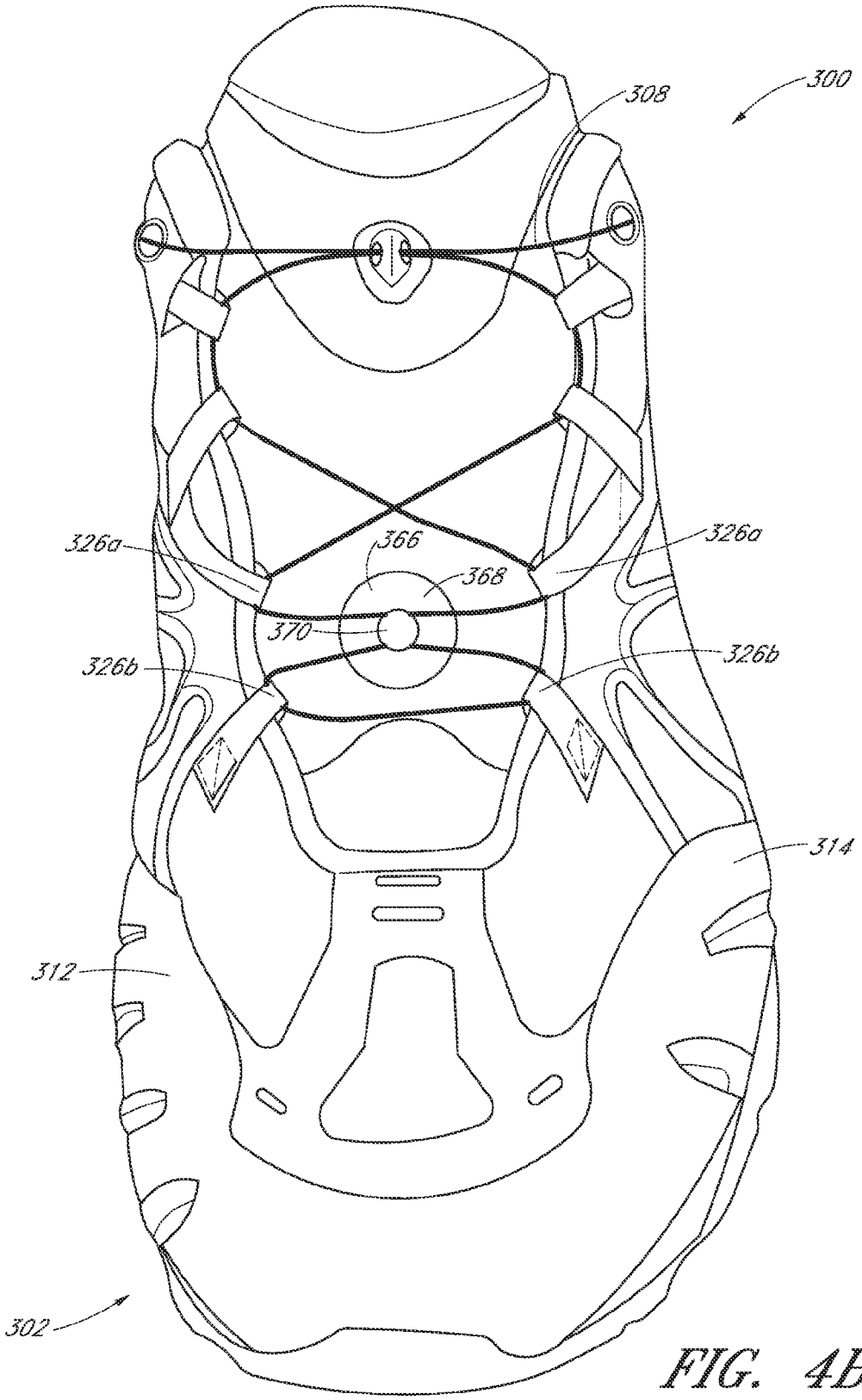
FIG. 4B is another view of the lacing system of FIG. 4A with the power zone mechanism in the engaged configuration.
Figure 5A:
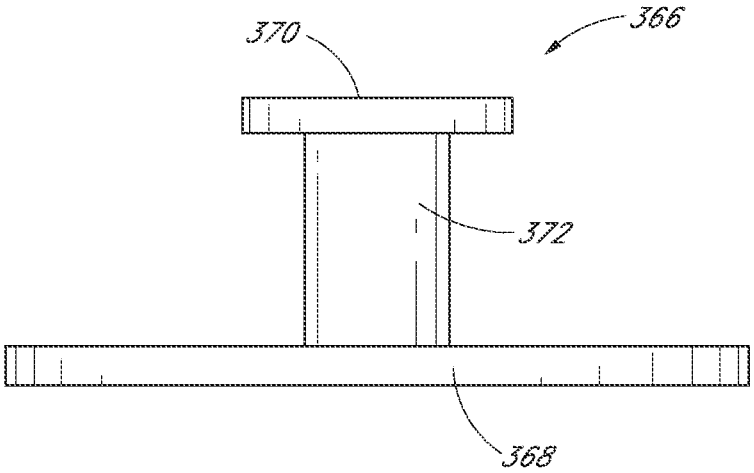
FIG. 5A is a side view of the power zone mechanism of FIG. 4A.

In some embodiments, such as the embodiment shown in FIGS. 4A-B, the lacing system 300 can include a power zone mechanism 366. The power zone mechanism 366 can add additional lace crossings or additional turns to the lace path, thereby increasing the tightening force in the region of the power zone mechanism 366. FIG. 4A shows the lacing system 300 with the power zone in it disengaged configuration. FIG. 4B shows the lacing system 300 with the power zone in its engaged configuration. FIG. 5A shows a side view of the power zone mechanism 366. The power zone mechanism 366 can include a base 368 that can be stitched, adhered, riveted, and/or otherwise coupled to the shoe 102 (e.g., to the tongue 316). The power zone mechanism 366 can be located in a generally central position between two lace guide elements 326*a-b* on the first side 312 of the shoe and two lace guide elements 326*a-b* on the second side 314 of the shoe 302. The power zone mechanism 366 can have a shaft 372 extending upward from the base 368, and the shaft 372 can be configured to receive a lace 308 therein when in the engaged configuration. A head piece 370 can be positioned at the top of the shaft 372 to maintain the lace 308 on the shaft 372.

In the disengaged configuration (see FIG. 4A), the power zone mechanism does not contact the lace 308 and does not substantially affect the operation of the lacing system 300. Accordingly in the engaged configuration, the lace 308 can be laced through the lacing system as discussed in connection with FIG. 1. In the engaged configuration, the length of lace 308 that extends between the first and second lace guide elements 326*a-b* is pull across and is received by the opposite edge of the shaft 372. The lace 308 extending between the first and second lace guide elements 326*a-b* on the first side 312 of the article can be pulled across to contact the side of the shaft 372 that faces towards the second side 314 of the shoe 302. The lace 308 extending between the first and second lace guide elements 326*a-b* on the second side 314 of the article can be pulled across to contact the side of the shaft 372 that faces towards the first side 314 of the shoe 302. The lace 308 can be slideable along the shaft 372 so that the lacing system can tighten and loosen the area of the lacing system having the power zone mechanism 366. The added lace crossings and lace turns create additional tightening force on the portion of the shoe having the power zone mechanism 366, thereby applying a tighter fit at that portion of the shoe 302. Although the embodiment shown in FIGS. 4A-B has one power zone mechanism 366, additional power zone mechanisms could be used, for example, generally centered above the illustrated power zone mechanism 366 generally centered between the lace guides 324*a* and 324*b*. In some embodiments, one side of the lace 308 (e.g., the side associated with side 312 of the shoe 302) can be coupled to the power zone mechanism 366 while the other side of the lace (e.g., the side associated with the side 314 of the shoe 302) is not coupled to the power zone mechanism 366. This can provide additional tightening for the region of the power zone mechanism 366, but not to the same degree as when both sides of the power zone mechanism 366 are used. In some embodiments, engaging the lace 308 onto the power zone mechanism 366 can introduce sharp turns into the lace path. Thus, for some embodiments, the power zone mechanism 366 functions best for lacing systems that use a highly flexible lace material (e.g., Spectra or thin steel strands).

Figure 5B:
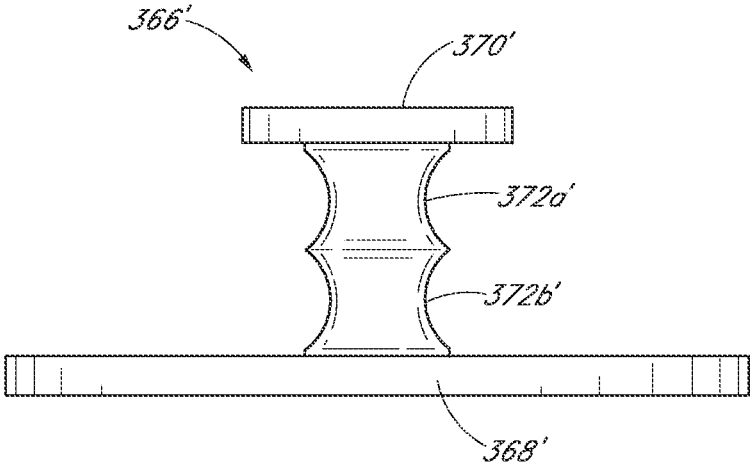
FIG. 5B is a side view of another example embodiment of a power zone mechanism.

FIG. 5B is an alternative design for a power zone mechanism 366' which can be similar to the power zone mechanism 366 previously described. The power zone mechanism 366' can have a base 368' and a head 370' to similar to the base 368 and the head 370 discussed above. The shaft for the power zone mechanism 366' of FIG. 5B can include two channels 372*a*' and 372*b*'. When in use, the lace 308 from side 312 would sit in one of the channels (e.g., 372*a*') and the lace 308 from the other side 314 would engage the other of the channels (e.g., 372*b*'). In some embodiments, only one side of the lace may be used with the power zone mechanism 366'.

In the embodiment shown in FIGS. 4A-B, the power zone mechanism 366 is attached to the tongue 316 of the shoe 302, but the power zone mechanism 366 could be positioned elsewhere on the shoe 302. For example, a power zone mechanism can be positioned on one side (e.g., first side 312) of the shoe 302. To engage the power zone mechanism, the portion of the lace 308 extending between the lace guide elements 326*a-b* on the opposite side (e.g., second side 314) can be pulled across to engage the power zone mechanism. In some embodiments, the power zone mechanism can be a disc, similar to that shown in FIGS. 5A-B, or the power zone mechanism can be hook, an open-back guide, or any other structure configured to selective receive the lace 308.

Figure 6:
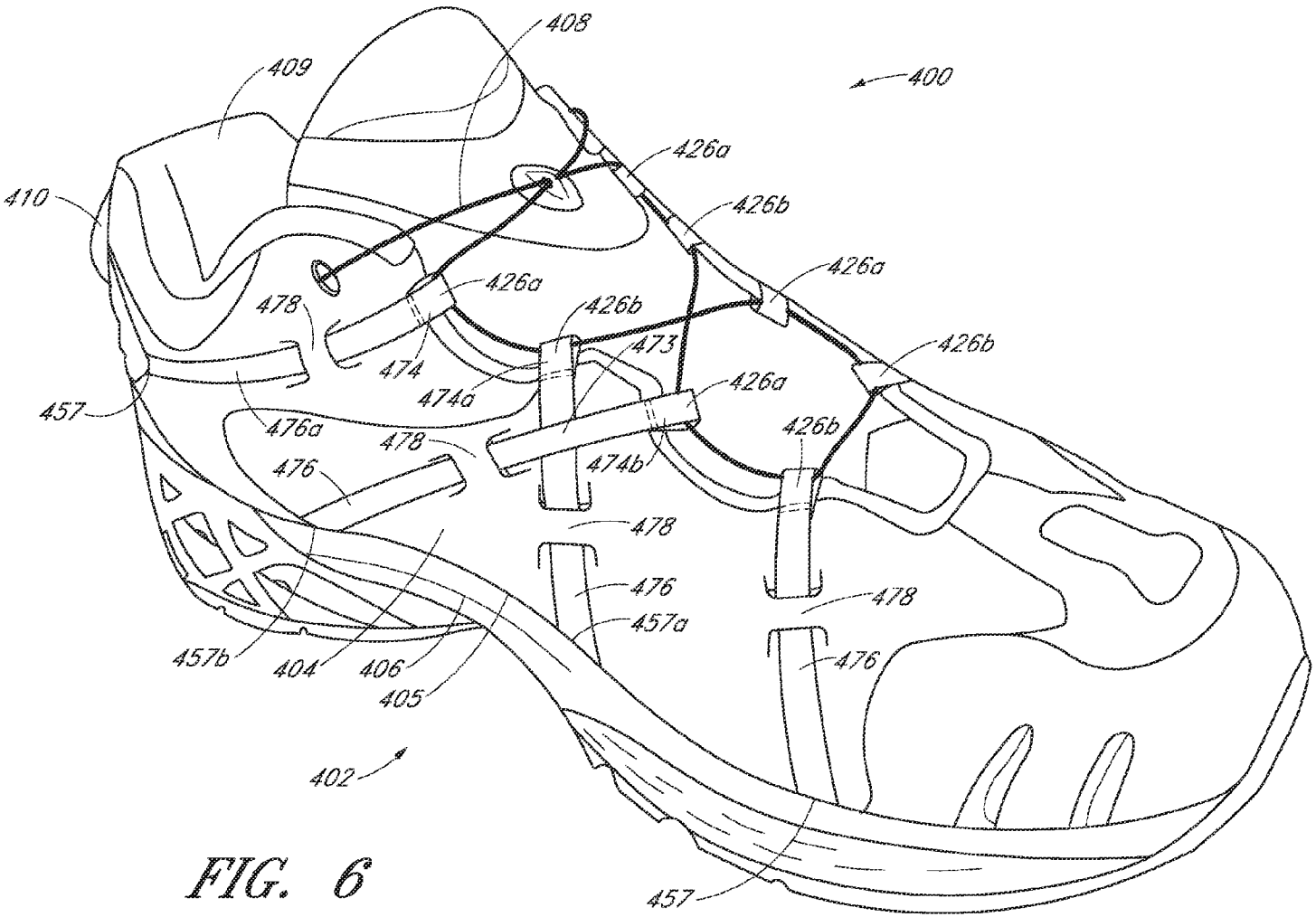
FIG. 6 is another example embodiment of a lacing system integrated into a shoe.

FIG. 6 is a perspective view of another example embodiment of a lacing system 400 incorporated into a shoe 402, although other article can also be used. The shoe 402, lace 408, and lace winder 410 can be similar to the shoe 100, lace 108, and lace winder 110 of FIG. 1, or any other shoe, lace, and lace winder discussed herein. Accordingly, much of the description given herein for the other embodiments of lacing systems also applies to the lacing system 400 of FIG. 6 and is not repeated in detail. The lacing system 400 can include pairs of lace guide elements 426*a-b* similar in many regards to the lace guide elements 126*a-b* discussed in connection with the lacing system 100 of FIG. 1. Accordingly much of the disclosure relating to the lacing system 100 of FIG. 1 applies also the example embodiment of FIG. 6. The lace guide elements 426*a-b* of the lacing system 400 can include a webbing loop 474 formed at the end of a strap 476. The strap 476 can couple to the shoe 402 (e.g., using an adhesive, stitching, rivet, and/or any other suitable manner) near a junction 405 between the sole 406 and the upper 404. In some embodiments, the strap can extend below the wearer's foot between the sole 406 and the upper 404. In some embodiments, the strap can wrap around the bottom of the upper 404 to the other side such that the strap on one side is connected to, and may be integral with, the corresponding strap on the other side of the shoe 402. In some cases, the two corresponding straps 476 on each side that are connected can be free sliding such that tension applied to the strap 476 on one side can pull and affect the strap 476 on the other side.

In some embodiments, the strap secures to the shoe 402 (e.g., to the upper 404) at a connection location 457. By adjusting the location of where the strap 476 attaches to the shoe 402 the distribution of the force applied by the tightened lace 408 can be adjusted. For example, the straps 476 of the lace guide elements 426 can cross (e.g., at location 473). Thus, when tension is applied by the lace 408 to the back loop 474*a* that is closer to the back of the shoe 402, the tension is transferred to the forward connection location 457*a* closer to the front of the shoe 402. Similarly, when tension is applied by the lace 408 to the front loop 474*b* that is closer to the front of the shoe 402, the tension is transferred to the back connection location 457*b* that is closer to the back of the shoe 402.

In some embodiments, one of the straps 476*a* (e.g., associated with the most rearward lace guide element 426*a*), can wrap back to the heel of the shoe 402. In some embodiments, the strap 476*a* can wrap completely around the heel (e.g., below the lace winder 410) so that the strap 476*a* continues around to the other side of the shoe 402 so that the heel straps on both sides are formed from a single piece of webbing that is free to slide back and forth as the lacing system 400 is tightened or loosened or during use of the shoe 402. Alternatively, a portion of the strap 476*a* extending around the heel is fixed to the shoe so that it does not slide. The heel straps 476*a* can tighten the collar 409 of the shoe 402 around the wearer's foot for an improved fit.

In some embodiments, the placement of the straps 476 (especially the most forward strap in the embodiment of FIG. 6) can be positioned so as to avoid the metatarsal joint of the foot where significant movement and bending of the shoe 402 during use can degrade the quality of the fit.

The shoe 402 can include a series of openings or belt-loops 478 to hold the straps 476 of the lace guide elements 426. The belt-loops 478 can prevent the lace guide elements 426 from flopping away from the shoe 402 when the lacing system 400 is loose. The belt loops 478 can be sufficiently large to allow the straps 476 to slide freely therein and shift from side to side as the lacing system 400 is tightened and as the system adjusts during use by the wearer. For example, the lace guide elements can have a width of at least about 4 mm and/or less than or equal to about 10 mm, or the width can be at least about 6 mm and/or less than or equal to about 8 mm. The belt-loops 478 can be wider than the lace guide elements 426 by at least about 2 mm and/or by less than or equal to about 25 mm, and in some embodiments, the belt-loops 478 can be wider than the lace guide elements 426 by at least about 5 mm and/or less than or equal to about 10 mm. Thus, the belt-loops 478 can be configured to prevent the lace guide elements 426 from flopping when loose, but can also allow for freedom of movement by the lace guide elements 426, both in the tightening and loosening direction, but laterally as well, such that the belt-loops 478 do not impede the natural positioning of the lace guide elements 426 as dictated by the fit of the shoe 402 on the wearer's foot. The belt-loops 478 can be formed as slits in the upper 404, or as additional material attached to the outside surface of the upper 404.

Figure 7:
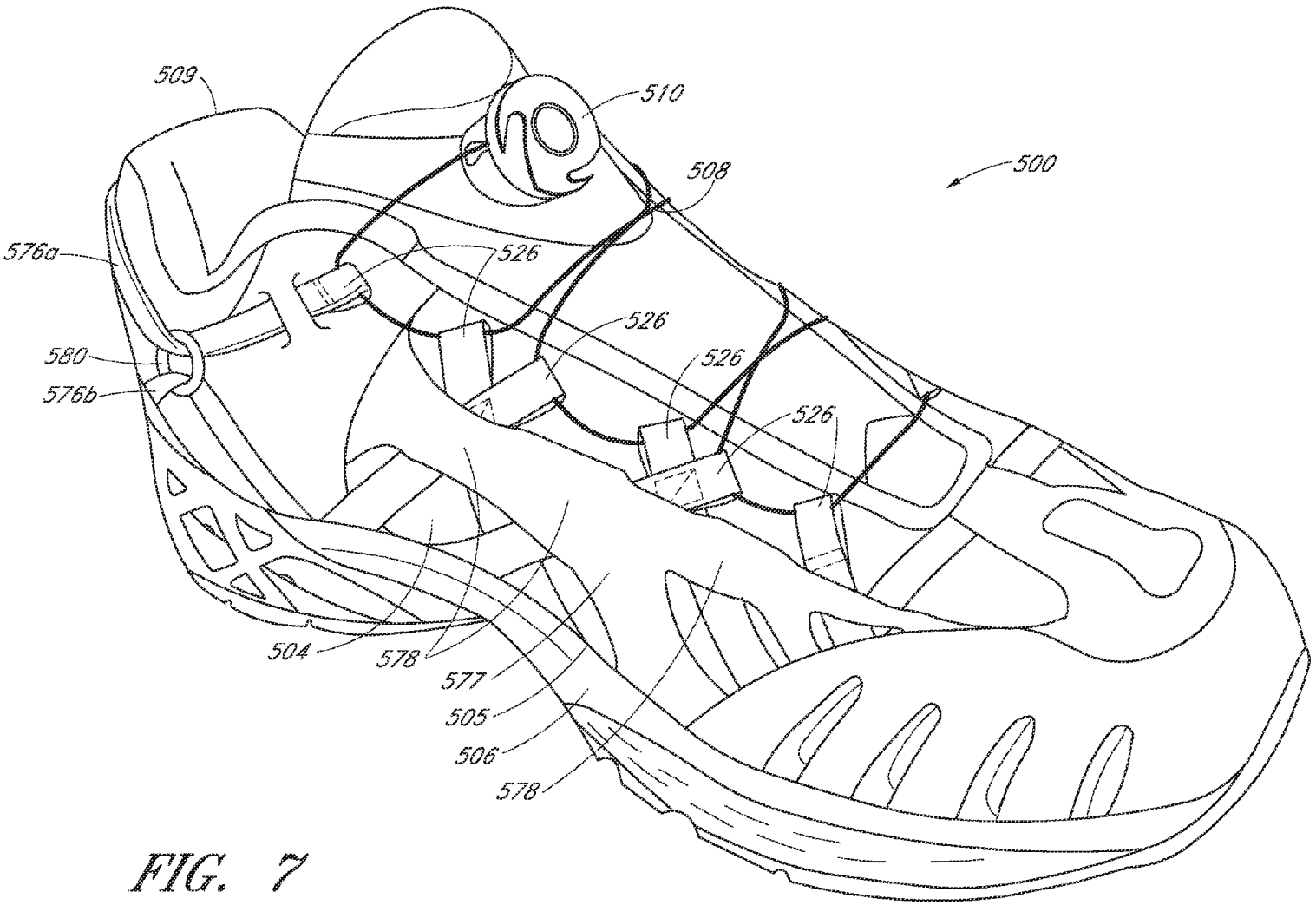
FIG. 7 is another example embodiment of a lacing system integrated into a shoe.

FIG. 7 is perspective view of another example embodiment of a lacing system 500 integrated into a shoe 502. The lacing system 500 can include a shoe 502, a lace 508, and a lace winder 510 which can be similar to those discussed in connection with the lacing system 400 or with any other lacing system discussed herein. Accordingly, much of the description given herein for the other embodiments of lacing systems also applies to the lacing system 500 of FIG. 7 and is not repeated in detail. In the lacing system 500, the lace winder 510 is shown mounted on the tongue 516 of the shoe 512. A patch 577 is attached to the outside of the upper 504 to form channels 578 to receive the lace guide elements 526 and prevent the lace guide elements 526 from flopping when loose. The patch 577 can be adhered and/or otherwise attached to the upper 504, but channels can be left open without any adhesive or other attachment mechanism to provide pathways 578 for the lace guide elements 526 to pass through. Many variations are possible. For example, the patch 577 can have cutout slits to receive each individual lace guide element strap, or in some cases multiple lace guide element straps can pass through a single belt-loop slit.

In the embodiment shown in FIG. 7, a ring 580 is suspended between an upper heel strap 576*a* and a lower heel strap 576*b*. The lower heel strap 576*b* can be secured to the shoe 502 at two locations near the bottom of the show, such as at or near the junction 505 between the sole 506 and the upper 504. The lower heel strap 576*b* can create a fixed length loop that does not change substantially in length as the lacing system 500 tightens or loosens, though if formed of a somewhat flexible material (e.g., webbing) it may give some as the system is tightened. The ring 580 is threaded onto the lower heel strap 576*b*. The upper heel strap 576*a* passes through the ring 580 and wraps around the heel of the shoe 502. The upper heel strap 576*a* can be free sliding and formed as an integral strap on both sides of the shoe 502, or the upper heel strap 576*a* can be attached to the heel of the shoe. As the lace 508 tightens the lacing system 500, the upper heel strap 576*a* applies force to the collar 509 of the shoe 502 around the wearer's foot. Threading the strap 576*a* through the ring 580 can advantageously direct tightening forces in multiple directions. For example, applying tension to the strap 576*a* can direct a tightening force around the collar 509 of the shoe 502 and can also pull upwards on the portion of the shoe 502 below the wearer's heel as it pulls upward on the lower strap 576*b*.

Figure 8:
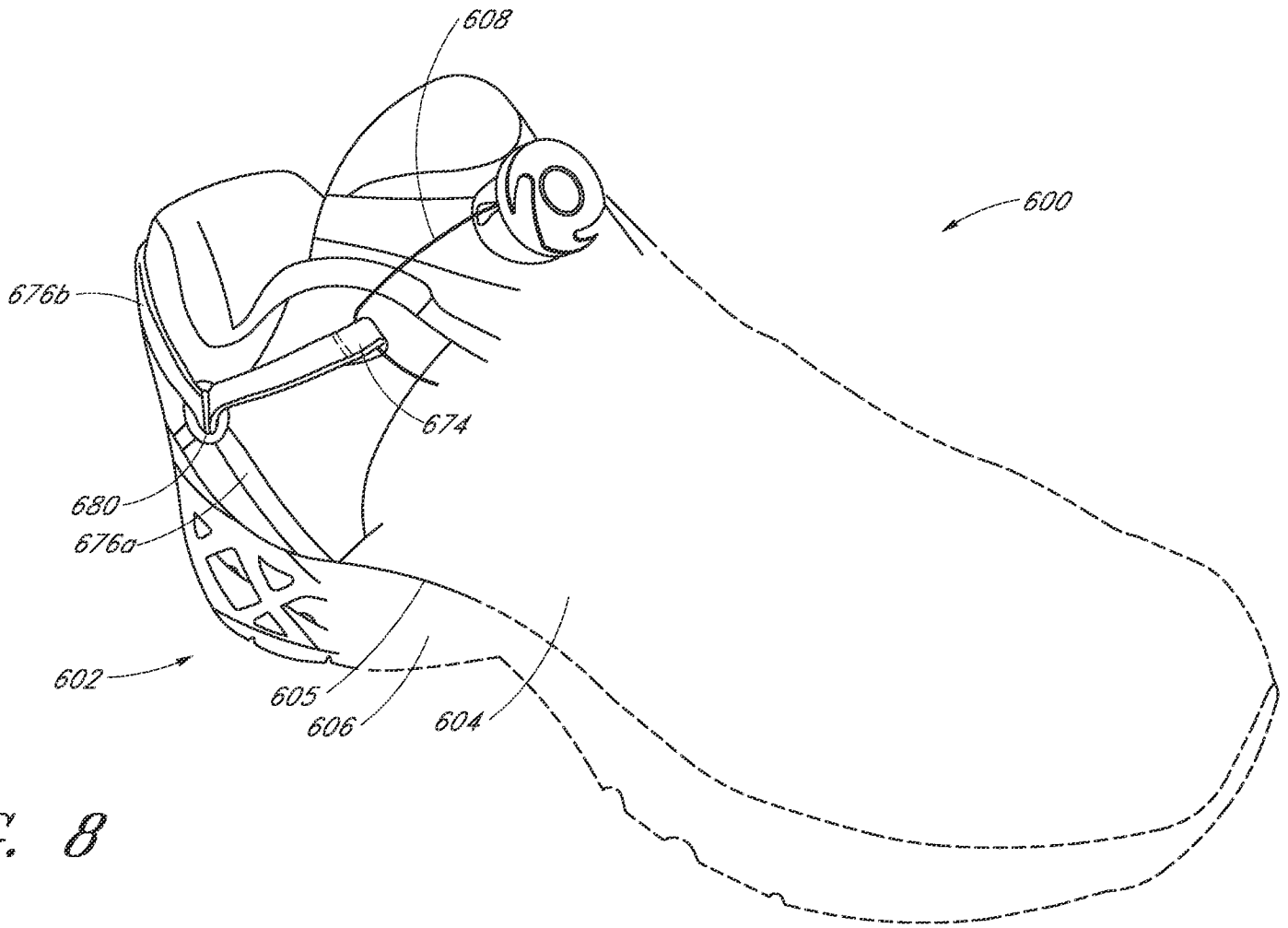
FIG. 8 is another example embodiment of a lacing system integrated into a shoe.

FIG. 8 is a partial perspective view of a lacing system 600 integrated into a shoe 602. The lacing system 600 can have features the same as, or similar to, the lacing system 500 of FIG. 7 or any other lacing system disclosed herein. Accordingly, much of the description given herein for the other embodiments of lacing systems also applies to the lacing system 600 of FIG. 8 and is not repeated in detail. The heel-tightening feature includes a front heel strap 676*a*, a back heel strap 676*b*, and a ring 680. The back heel strap is attached at one end at the heel of the shoe at or near the junction 605 between the upper 604 and the sole 606. The back heel strap 676*b* passes through the ring 680 and up to the top of the heel portion of the shoe 602. The back heel strap 676*b* can pass through a guide and continue on to a similar ring on the opposite side of the shoe, or the back heel strap 676*b* can attach to the shoe near the top of the heel. The front heel strap 676*a* can attach to the shoe 602 at or near the junction 605 between the upper 604 and the sole 606, pass through the ring 680, and end with a loop 674 that receives the lace 608. As the lace 608 tightens, the front heel strap 676*a* is drawn forward and upward, which draws the ring 680 forward. The ring 680 pulls the back heel strap forward tightening the heel of the shoe against the wearer's foot.

Figure 9:
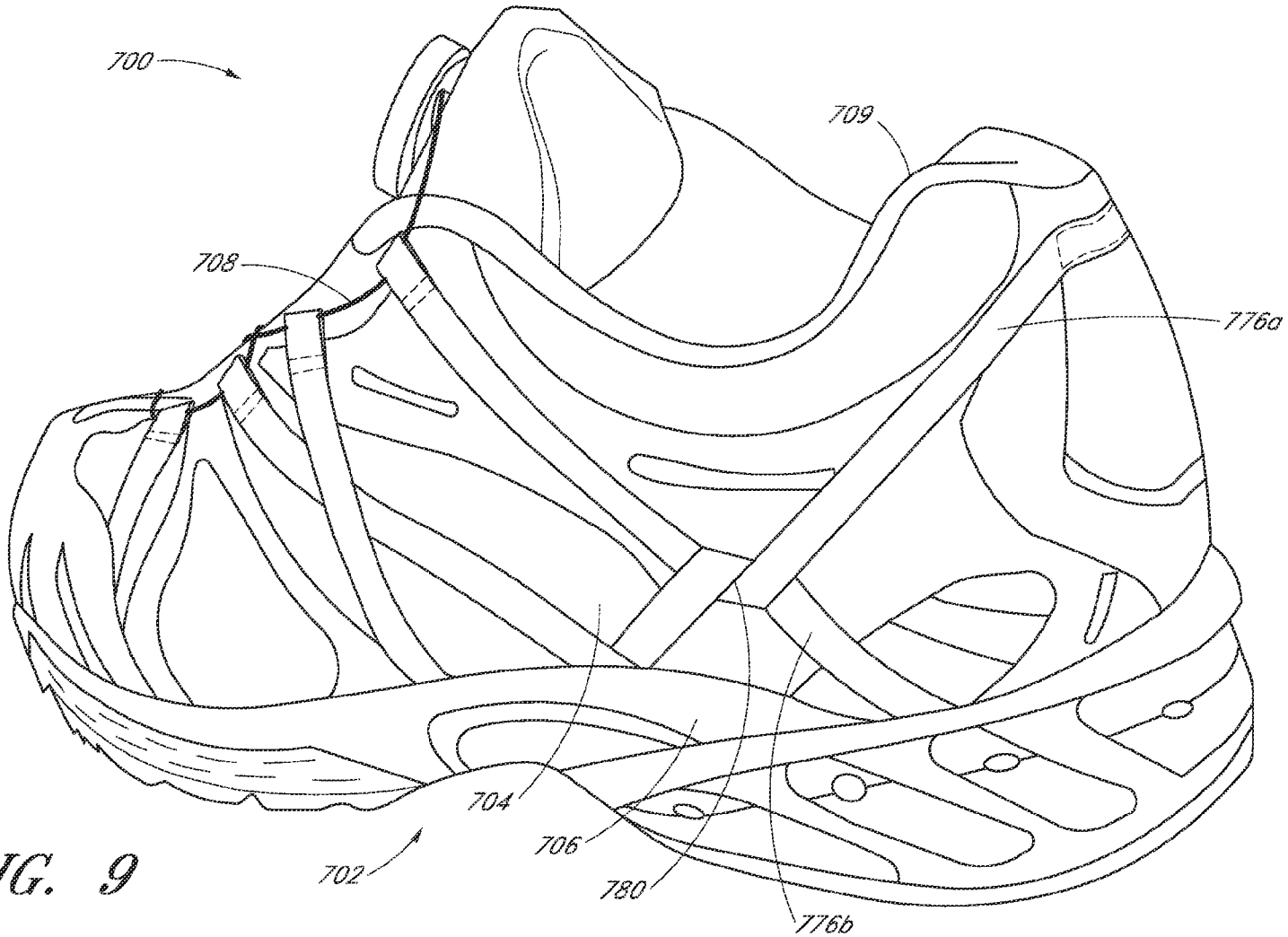
FIG. 9 is another example embodiment of a lacing system integrated into a shoe.

FIG. 9 shows an example embodiment of a lacing system 700 integrated into a shoe 702, which has features similar to, or the same as, the other lacing systems disclosed herein. Accordingly, much of the description given herein for the other embodiments of lacing systems also applies to the lacing system 700 of FIG. 9 and is not repeated in detail. The lacing system 700 includes a collar closing system similar to that of the lacing system 500 of FIG. 7, but the lacing system 700 does not include a ring. The lower heel strap 776*b* attached at two locations at or near the junction 705 between the upper 704 and the sole 706, thereby creating a loop. The upper heel strap 776*a* is threaded through the loop created by the lower heel strap 776*b*, and then attaches (e.g., by stitching or any other suitable manner) to the shoe near the top of the heel. Thus, the upper heel strap 776*a* engages the lower heel strap 776*b* at a movable cross point 780. When the lace 708 it tightened, the upper heel strap 776*a* is drawn tighter, causing the position of the movable cross point 780 to shift (e.g., some of the upper heel strap 776*a* can slide through the cross point 780), and the upper heel strap 776*a* pulls the collar 709 of the shoe 702 more tightly closed around the wearer's foot.

Figure 10:
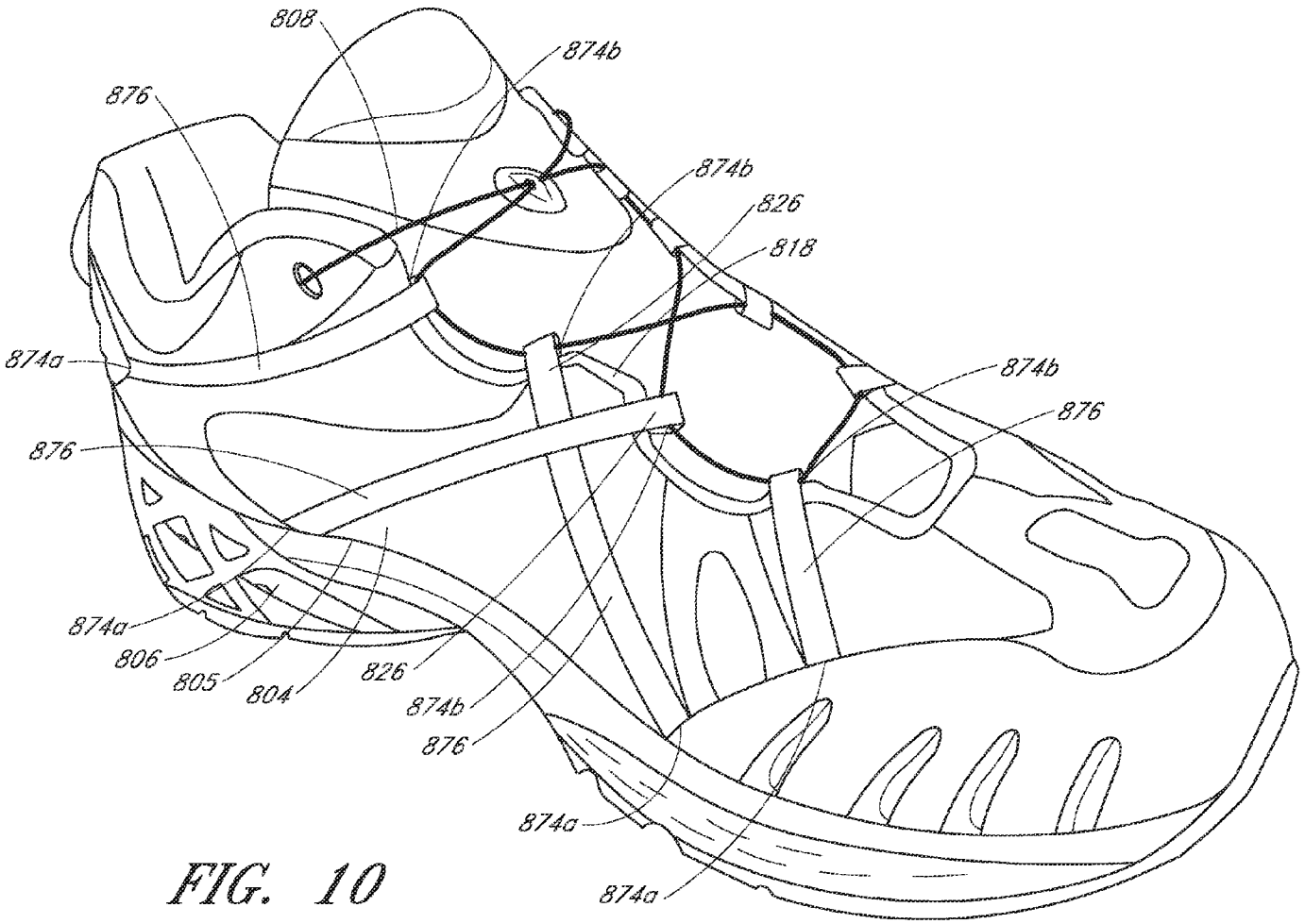
FIG. 10 is another example embodiment of a lacing system integrated into a shoe.

FIG. 10 is an example embodiment of a lacing system 800, which can be similar to, or the same as the other lacing systems disclosed herein. Accordingly, many of the details described in relation to the other embodiments herein also apply to the lacing system 800, and are not repeated in detail. The lacing system 800 can include pairs of lace guide elements 826. The lace guide elements 826 can have a first end 874*a* coupled to the shoe 802 at a first location (e.g., at or near the junction 805 between the upper 804 and the sole 806). The second ends 874*b* of the lace guide elements 826 are coupled to the shoe 802 as a second location (e.g., at or near the tightening edge 818). The length of the straps 876 are longer than the corresponding distance between the first and second locations 874*a*, 874*b*, such that, when tension is applied, the slack in the straps 876 is pulled toward the lace 808 and toward the opposite side of the shoe 802, thereby creating a lace path through the lace guide elements 826 that is closer to the opposing side of the shoe than either of the first and second attachment locations 874*a*, 874*b*. As the lacing system 800 is tightened and loosened, and as a result of shifting and adjustments from use of the shoe, the straps 876 can slide slightly relative the lace, such that the lace 808 can side along different portions of the straps 876 at different times. This can result in less wear on the lace guide elements 826 over time, since the lace 808 will rub against different portions of the strap 876 instead of always rubbing against the same looped portion.

Figure 11:
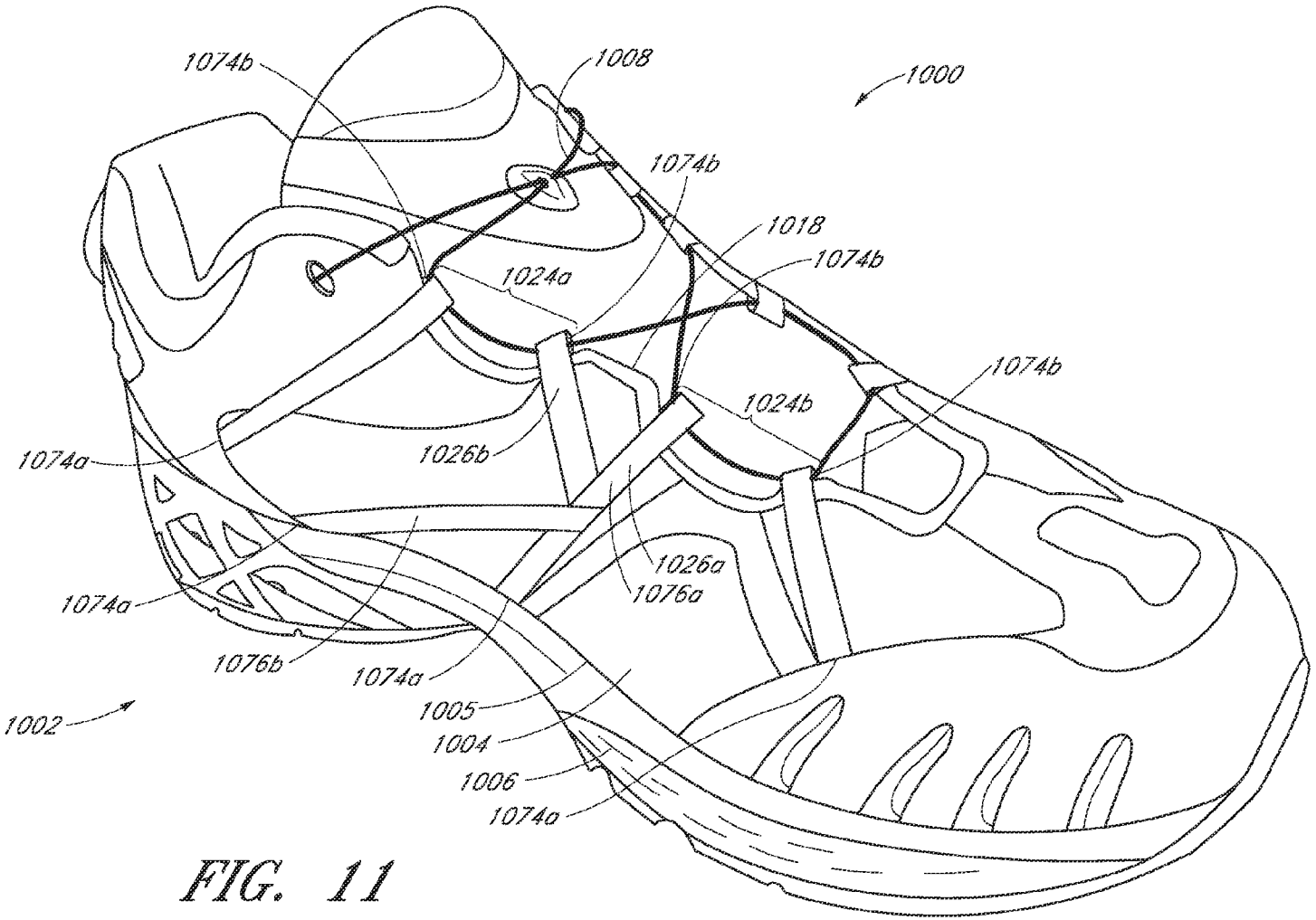
FIG. 11 is another example embodiment of a lacing system integrated into a shoe.

FIG. 11 is an example embodiment of a lacing system 1000 incorporated into a shoe 1002. The lacing system 1000 can have features similar to, or the same as, the other lacing systems disclosed herein. Accordingly, many of the details described in connection with other embodiments herein also apply to the lacing system 1000, and are not repeated in detail. The lacing system 1000 can have lace guide elements 1026 with first ends that attach to the shoe 1002 at first attachment points 1074*a* and second ends that attach to the shoe at second attachment points 1074*b*, similarly as described in connection with FIG. 10. The first attachment points 1074*a* can be, in some cases, at or near the junction 1005 between the upper 1004 and sole 1006 of the shoe 1002. The second attachment points 1074*b* can be, in some cases, at or near the tightening edge 1018. In some embodiments, adjacent lace guides 1024*a* and 1024*b* on one side 1012 of the lacing system 1000 can be coupled together. For example, the strap 1076*b* of the second lace guide element 1026*b* of the first lace guide 1024*a* can wrap around the strap 1076*a* of the first lace guide element 1026*a* of the second lace guide 1024*b*. Thus, when a tightening force is applied to the second lace guide element 1026*b* of the first lace guide 1024*a*, a portion of that tightening force is transferred via the crossing straps 1076*a* and 1076*b* to the first lace guide element 1026*a* of the second lace guide 1024*b*. In some embodiments, one or both of the crossing straps 1076*a*, 1076*b* can change directions at the crossing. In the illustrated embodiment, the strap 1076*b* of the second lace guide element 1026*b* of the first lace guide 1024*a* changes direction such that the first end of the lace guide element 1026*b* at the first attachment point 1074*a* is positioned further from the second lace guide 1024*b* than is the second end of the lace guide element 1026*b* that engages the lace 1008. Thus, the distribution of the force applied by tightening the lace 1008 onto the shoe 1002 can be varied by wrapping the lace guide elements 1026*a-b*. In the illustrated embodiment, the lace guide element 1026*a* does not substantially change direction at the crossing location, but in some embodiments, it can be configured to change direction similar to the lace guide element 1026*b*. Although the wrapping lace guide elements are described using lace guide elements 1026*a-b* that attach to the shoe at or near the junction 1005 and at or near the tightening edge 1018, the other embodiments described herein can be modified to have wrapping straps. For example, the wrapping lace guide elements 1026*a-b* can have a loop formed at the second end to engage the lace 1008 and can have a single attachment location (e.g., at or near the junction 1005).

Figure 12:
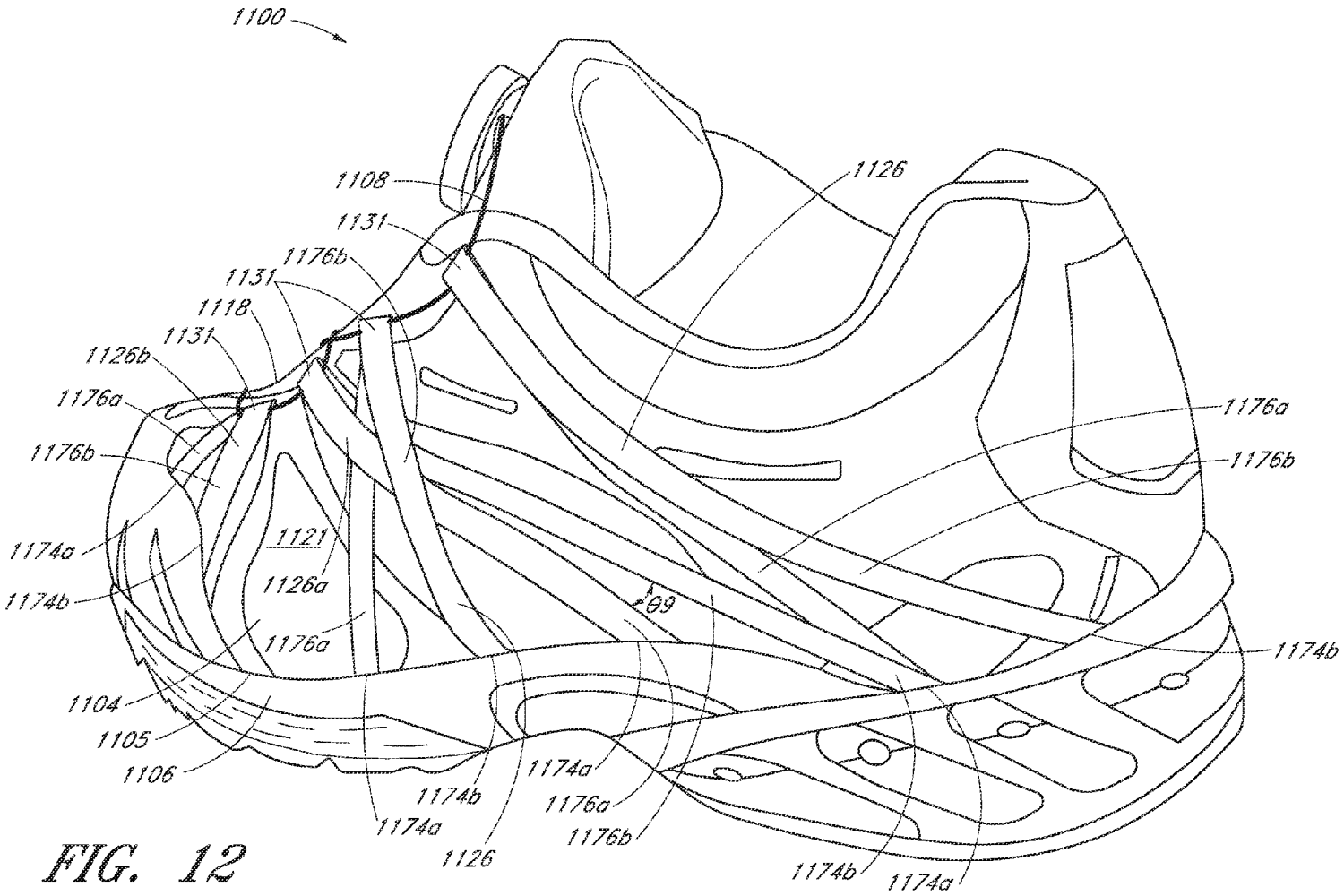
FIG. 12 is another example embodiment of a lacing system integrated into a shoe.

FIG. 12 is an example embodiment of a lacing system 1100 incorporated into a shoe 1102. The lacing system 1100 can have features similar to, or the same as, the other lacing systems disclosed herein. Accordingly, many of the details described in connection with other embodiments herein also apply to the lacing system 1100, and are not repeated in detail. The lace guide elements 1126 can have first ends that attach to the shoe 1102 at first attachment positions 1174*a* and second ends that attach to the shoe at second attachment positions 1174*b*. In some embodiments, both the first and second attachment positions 1174*a* and 1174*b* can be at or near the junction 1105 between the sole 1106 and the upper 1104 of the shoe 1102. In some embodiments, the first and second attachment positions 1174*a* and 1174*b* can be about the same distance from the lace path 1131 through the lace guide element 1126 such that the lace guide element 1126 forms a large loop configured to engage the lace 1108 at or near the tightening edge 1118 of the shoe 1102. A first strap portion 1176*a* can extend from the first attachment position 1174*a* to the lace path 1131, and a second strap portion 1176*b* can extend from the second attachment position 1174*b* to the lace path 1131. In some embodiments, the first and second attachment positions 1174*a* and 1174*b* can be offset such that the first and second strap portions 1176*a* and 1176*b* extend in different directions, forming an angle θ9 therebetween. The angle θ9 can be at least about 5° and/or less than or equal to about 35°, or the angle θ9 can be at least about 15° and/or less than or equal to about 25°, or the angle θ9 can be about 20°. By separating the first and second attachment positions 1174*a* and 1174*b*, the force applied by tightening the lace 1108 can be more evenly distributed onto the shoe 1102. The strap portions 1176*a-b* can extend down across the sides of the shoe 1102 and attach at the junction 1105 to provide lateral support for the shoe 1102, similar to other embodiments described herein. By separating the first and second attachment positions 1174*a* and 1174*b* and angling the first and second strap portions 1176*a* and 1176*b* with respect to each other, the lateral support supplied by the straps 1176 can be more evenly distributed.

In the lacing system 1100 of FIG. 12, and in many of the other lacing systems described herein, the lace guide elements 1126 can be configured to not cross the metatarsal joint 1121. Metatarsal joint 1121 can be configured to bend significantly during use of the shoe 1102. Thus, if the lace guide elements 1126 were to cross the metatarsal joint 1121, the bending and associated change in dimensions could loosen the tension on the lace guide elements 1126. By not crossing the metatarsal joint 1121, the lace guide elements 1126 can be substantially unaffected by bending that occurs at the metatarsal joint 1121. Also, if the lace guide elements 1126 cross the metatarsal joint 1121, the lace guide elements 1126 can interfere with the bending of the metatarsal joint 1121 and reduce the effectiveness of the shoe 1102. In some embodiments, a first lace guide element 1126*a* can be positioned rearward of the metatarsal joint 1121, and a second lace guide element 1126*b* can be positioned forward of the metatarsal joint 1121.

Figure 13:
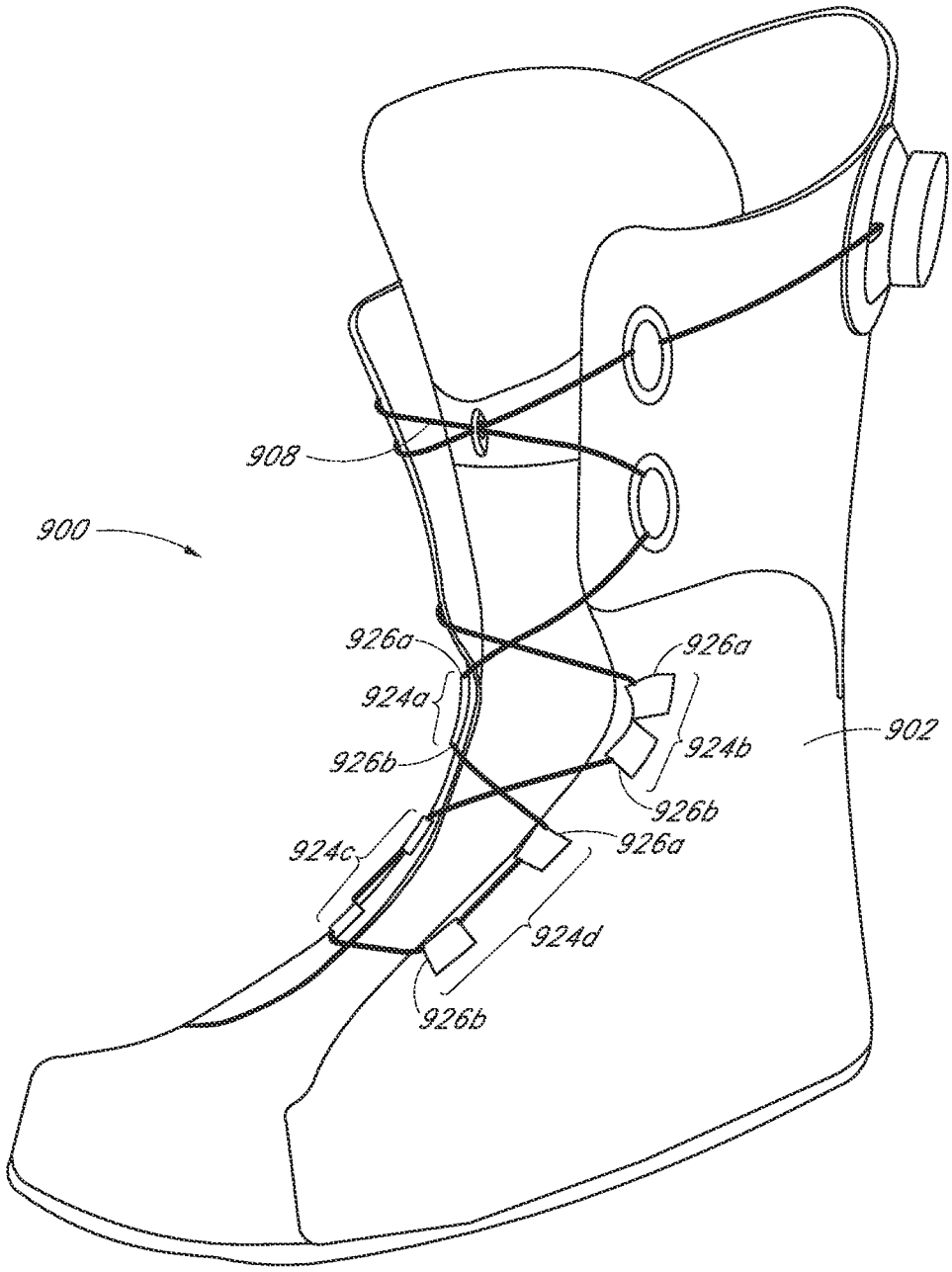
FIG. 13 is an example embodiment of a lacing system integrated into a boot liner.

FIG. 13 is an embodiment of a lacing system 900 integrated into a footwear liner for use with a ski boot 902. Much of the description given herein for the other embodiments of lacing systems also applies to the lacing system 900 of FIG. 13 and is not repeated in detail. The lacing system 900 can have four lace guides 924*a-d* that include pairs of lace guide elements 926*a-b* that are angled towards each other as described herein (e.g., in connection with the lacing system 100 of FIG. 1. Although the illustrated embodiment includes lace guides 924 that are similar to those described in connection with FIG. 1, the lace guides of any of the other lacing system described herein can be incorporated into the boot liner 902. The lace guide elements 926*a-b* can be spaced apart, as is the case for the lace guide elements 926*a-b* of the lace guides 924*c-d*, or the lace guide elements 926*a-b* and be touching, as is the case for the lace guide elements of the lace guides 924*a-b*. Touching pairs of lace guide elements can be incorporated into the other embodiments disclosed herein as well. The lace 908 is threaded through consecutive lace guide elements 926*a-b* on one side of the liner before the lace 908 crosses to the opposing side, as described in greater detail above. The lace guide elements 926*a-b* can be made from flexible webbing materials, as described herein. The flexible webbing materials can be particularly beneficial for a ski boot liner 902 because the liner 902 is intended to be worn inside a semi-rigid boot (not shown). If the liner 902 uses rigid protruding lace guides, the boot can cause discomfort to the wearer by pressing the rigid protruding guides against the wearer, and may even cause damage to the guides themselves or interfere with the functionality of the lacing system. Thus, the flexible webbing guide elements 926 of the lacing system 900 can be particularly beneficial for ski boot liners, or other footwear intended to be enclosed within a rigid boot or other rigid member.

Figure 14B:
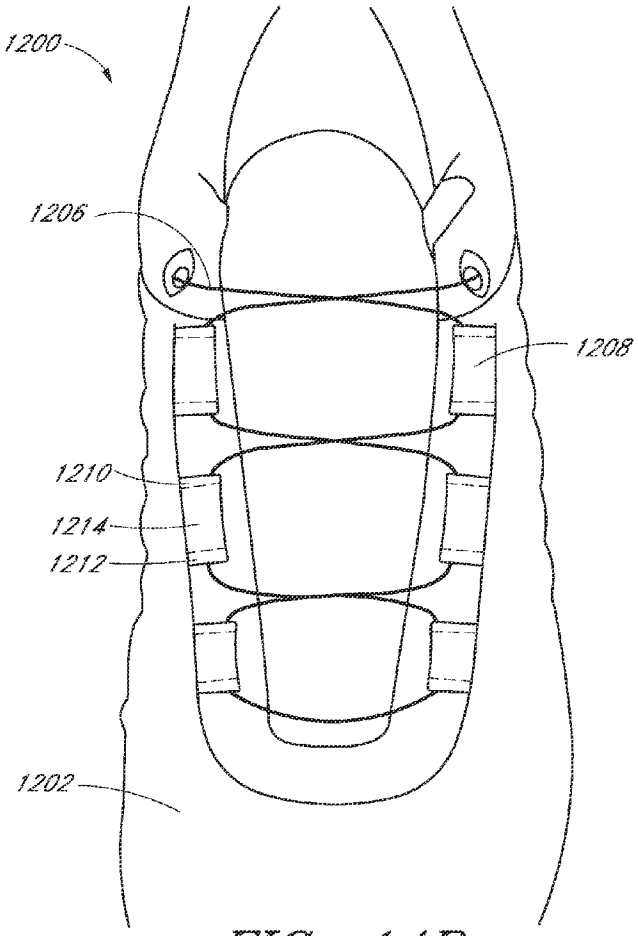
FIG. 14B is a view of the lacing system of FIG. 12A with the lace in a relaxed state.
Figure 14A:
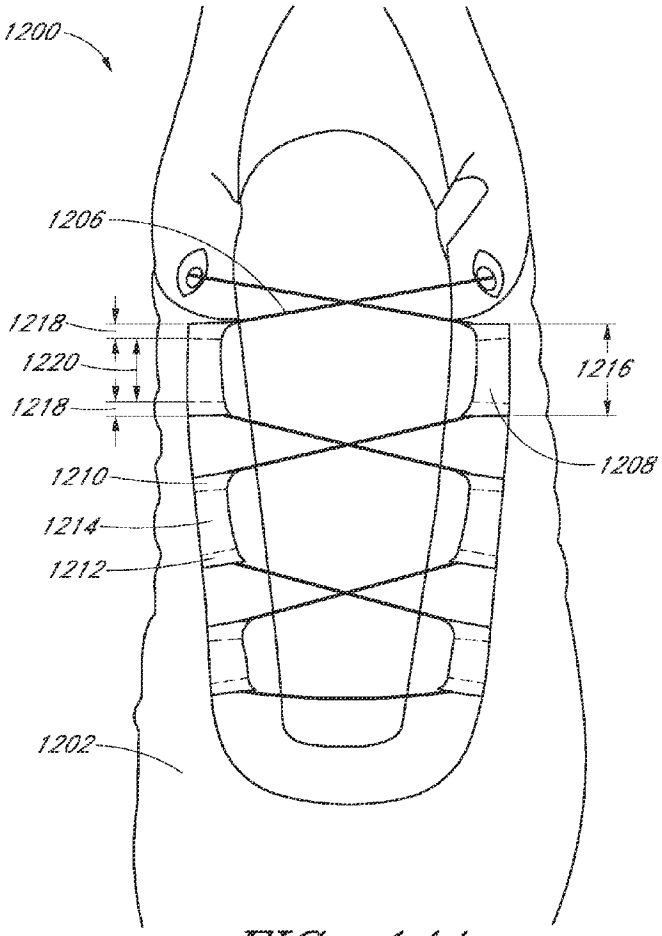
FIG. 14A is an example of a lacing system with tension applied to the lace.

With reference now to FIGS. 14A and 14B, in some embodiments, a lace guide 1208 can be formed from a flexible piece of webbing and the lace guide 1208 can have end regions 1210, 1212 that are more flexible than the center region 1214. While the embodiment shown in FIGS. 14A-B shows the flexible end region type lace guides used individually, the embodiments described herein that use multiple (e.g., pairs) of lace guide elements to form a lace guide can also have end regions that are more flexible than the center regions, similar to the embodiments described in connection with FIG. 14A-B.

The center region 1214 of the guide 1208 can include an additional layer of material that can be attached over a flexible piece of webbing to reduce the flexibility of the center region 1214. The additional layer of material can be made of the same material as the flexible piece of webbing, or it can be a different, less flexible material. As tension is applied to the lacing system 1200, first end region 1210 and second end region 1212 will tend to flex or curve to create a curved lace pathway that does not present sharp turns to the lace 1206. Curvature of the guide 1208 at the end regions 1210, 1212 can reduce wear and friction on both the guide 1208 and the lace 1206. The stabilized center region 1214 can assist keeping the first end region 1210 and second end region 1212 separated and prevent the flexible guide from bunching together even when the system 1200 is under load during normal use. The center region 1214 can prevent bunching without the use of a rigid material which may be undesirable in certain applications.

In the embodiment shown in FIGS. 14A and 14B, six guides 1208 are shown, although it will be understood than any other suitable number of guides 1208 may be used. The guides 1208 can include a first end region 1210, a second end region 1212, and a center region 1214 located between the first and second end regions 1210, 1212. In the embodiment shown, the guides 1208 can be made of generally flexible material such as woven webbing made of polyester, nylon, or any other suitable material or blend of materials. The generally flexible guides 1208 can provide the advantage that in some instances they can reduce pressure points as compared to rigid molded guides. The generally flexible woven guides 1208 can also provide the appearance that they will produce less pressure points than rigid guides, making the flexible guides 1208 more appealable to the consumer. The woven guides 1208 can also be less visually dominating than the rigid molded guides, which can be desirable in certain embodiments. Flexible woven guides 1208 can also be less expensive than rigid molded guides to manufacture and/or install.

The guides 1208 can be formed from woven material and can be attached to the shoe 1202 by stitching or by adhesive or by rivets or in any other suitable manner. In some embodiments, a guide 1208 can be made from a strip of woven material that is folded to create a loop. The ends of the strip of woven material can then be stitched together individually and attached to the shoe or may be stitched together to the shoe, thereby securing the strip of woven material to the shoe with the loop facing inward generally toward the center of the shoe. In some embodiments, the loop may face inward toward the center of the opening if the opening is offset from the center of the shoe, as may be advantageous in certain applications as in biking shoes.

The woven guides 1208 can provide a lace path that prevents the lace 1206 from turning any sharp corners (e.g., corners with a radius of less than about 2 mm, 3 mm, 5 mm, 7 mm, or 10 mm) during normal use. In some embodiments, the guides 1208 can be flexible and can provide a variable lace path having variable radii of curvature. FIG. 14A shows the lacing system 1200 in a tightened configuration. As can be seen in FIG. 14A, when tightened, the first and second end regions 1210, 1212 can stretch to partially conform to the lace path. By selecting a material for the first and second end regions 1210, 1212 with an appropriate amount of flexibility for the anticipated tension to be applied to the lacing system 1200, the first and second end regions 1210, 1212 can be configured to maintain a lace path without sharp corners at either end of the guide 1208 as shown in FIG. 14A. The pressure between the lace 206 and the guide 208 can thus be spread over a larger surface area than if the lace 1206 were forced to turn a sharp corner at the end of a rigid guide, thereby reducing wear on both the lace 206 and the guide 208. Preferably, the center region 214 has sufficient strength so as to resist bending, thus maintaining a degree of separation between first and second end regions 1210, 1212.

FIG. 14B shows the lacing system 1200 in a relaxed state. As can be seen by comparing FIG. 14A to FIG. 14B, the first and second end regions 1210, 1212 can be configured to stretch and conform more than the center region 1214. When relaxed, as shown in FIG. 14B, the first and second end regions 1210, 1212 of the guide 1208 can relax to form a substantially linear lace path through the guide. When tightened, as shown in FIG. 14A, the center region 1214 can remain substantially undeformed and can maintain a substantially linear lace path, while the first and second end regions 1210, 1212 can flex to provide a smooth, curved lace path as the lace exits the ends of the guide 1208.

The guides 1208 can have a width 1216 of at least 10 mm and/or no more than about 45 mm, although widths outside these ranges can also be used. The first and second end regions 1210, 1212 can have the same, or similar, or different widths. The width 1218 of the first and/or second end regions 1210, 1212 can be at least about 1 mm, at least about 2 mm, at least about 3 mm, at least about 5 mm, at least about 7 mm, at least about 10 mm, no more than about 15 mm, no more than about 10 mm, no more than about 7 mm, and/or no more than about 5 mm, although widths outside these ranges can also be used. The center region can have a width 1220 of no more than about 1 mm, no more than about 3 mm, no more than about 5 mm, no more than about 10 mm, no more than about 20 mm, no more than about 30 mm, or no more than about 40 mm. The center region can have a width 1220 of at least about 0.5 mm, at least about 1 mm, at least about 3 mm, at least about 5 mm, at least about 10 mm, at least about 20 mm, or at least about 30 mm. Other widths can also be used.

The webbing of the guides 1208 can have a thickness of about 0.5 mm to about 0.8 mm. Other thicknesses can be used depending on the strength and durability required for the lacing system. In some embodiments a webbing with a thickness of about 1.75 mm can be used to provide additional strength (e.g., for applications where high tension is expected). In some embodiments, the center region 1214 can be thicker than the end regions 1210, 1212.

In some embodiments, the center region 1214 of the guide 1208 can be made from a different, more rigid material than the first and second end regions 1210, 1212. The different materials can be woven together, or connected by an adhesive, or stitched together, or connected in any other suitable manner. The center region 1214 and the end regions 1210, 1212 can be made from a woven material where the center region 214 is more tightly woven providing a denser and less flexible central region 1214.

Many variations are possible. For example, in some embodiments, the guides 1208 can have permanently curved ends. Thus, in the relaxed state, the guides 1208 can maintain the form shown in FIG. 14A instead of returning to a strait, unflexed position. For example, a radius can be set in the lace guides 1208 by stitching the front edge of the guide 1208 with a curved stitch path, or by welding the webbing guide 1208 along the front edge in a curved path.

In some embodiments, the entire guide can be formed of a flexible material, such that the center region 1214 has substantially the same flexibility as the end regions 1210, 1212. Because a single material can be used, the cost of the guides can be reduced. In some embodiments, the guide can form a single arc lace path when the lace is tightened. In some embodiments, the less flexible center region 1214 can provide the benefit of resisting compression along the width of the guide 1208 thereby preventing the guide from bunching up when the lace 1206 is tightened.

In some embodiments, the lace guides disclosed herein can provide a low friction and durable sliding surface for the lace to move across in both the relaxed and tightened positions. In some circumstances, there can be considerable movement between the lace and the guides under tension as the shoe is used. The guides can be made from material (e.g., webbing) that can be dyed or otherwise colored, that can be washed without loosing color or shrinking, and is not affected significantly by environmental changes such as humidity or temperature. As discussed above, polyester, nylon, or various other materials and material blends can be used to form the guides.

In some embodiments, the guides discussed herein can include holes (not shown) to allow dirt that becomes caught in the guides to exit the guides. Dirt that is allowed to remain in the guides can cause friction and wear between the lace and the guide.

In many embodiments, the figures illustrate one side of the lacing systems described herein. In some embodiments, the lacing system can be generally symmetrical such that the side of the shoe, or other footwear or article, not specifically shown can have similar features to those shown in the figures. In some embodiments, the lacing systems can be asymmetrical and can have different features on the first and second opposing sides.

While discussed in terms of certain embodiments, it should be appreciated that the disclosure is not so limited. The embodiments are explained herein by way of example, and there are numerous modifications, variations and other embodiments that may be employed that would still be within the scope of the present invention. Components can be added, removed, and/or rearranged both within certain embodiments and between embodiments. Additionally, processing steps may be added, removed, or reordered. A wide variety of designs and approaches are possible. Where numerical values and/or ranges are disclosed, other numerical values can also be used. For example, some embodiments can use numerical values that are outside the disclosed ranges.

For purposes of this disclosure, certain aspects, advantages, and novel features of embodiments of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

The following is claimed:

1. A lacing system for tightening footwear, the footwear having a sole and an upper that includes a tightening edge, the lacing system comprising:

a tightening mechanism;

a lace that is tensionable via the tightening mechanism; and a lace guide that guides the lace about a lace path of the footwear, the lace guide having:

a first end that is coupled to the footwear at a first attachment location adjacent a junction between the upper and the sole; and a second end that is coupled to the footwear at a second attachment location adjacent the tightening edge;

wherein the lace guide is positioned on one side of the upper and the second end of the lace guide is folded toward an opposite side of the upper to form a loop within which the lace is disposed, and wherein a length of the lace guide is longer than a distance between the first and second attachment locations such that when tension is applied to the lace via the tightening mechanism, a portion of the loop is pulled toward an opposite side of the footwear and the portion of the loop is closer to the opposite side of the footwear than the tightening edge.

2. The lacing system of claim 1, wherein the lace guide is a fabric strap.

3. The lacing system of claim 1, wherein the lace guide is positioned on an exterior surface of the upper.

4. The lacing system of claim 1, wherein the lacing system includes a plurality of lace guides positioned on a first side and a second side of the footwear.

5. The lacing system of claim 4, wherein a first lace guide crisscrosses with a second lace guide.

6. The lacing system of claim 1, wherein at least a portion of the lace guide is disposed within a channel formed between the upper and an additional material layer.

7. The lacing system of claim 1, wherein the lace guide is a first lace guide, and wherein the lacing system includes a second lace guide, the first and second lace guides being angled toward one another so as to operatively guide a portion of the lace from across an opening of the footwear, along the tightening edge, and back across the opening of the footwear.

8. The lacing system of claim 1, wherein the first attachment location is at the junction between the upper and the sole.

9. The lacing system of claim 1, wherein the second location is at the tightening edge.

10. A lacing system for footwear comprising:

a lace; and a lace guide that is coupleable with the footwear to guide the lace about the footwear, wherein when coupled with the footwear:

a first end of the lace guide is coupled at a first attachment location adjacent a junction between an upper and a sole of the footwear;

a second end of the lace guide is coupled at a second attachment location adjacent a tightening edge of the footwear; and the lace guide is positioned on one side of the upper with the second end curling toward an opposite side of the upper to form a loop within which the lace is disposed, wherein a length of the lace guide is longer than a distance between the first and second attachment locations such that when the loop is tensioned via the lace, a portion of the loop is pulled closer to an opposite side of the footwear than the tightening edge.

11. The lacing system of claim 10, wherein the first attachment location is at the junction between the upper and the sole.

12. The lacing system of claim 10, wherein the second location is at the tightening edge.

13. A method of forming a lace guide on footwear comprising:

providing a footwear having:

a sole;

an upper that includes a tightening edge;

a tightening mechanism; and a lace that is tensionable via the tightening mechanism;

positioning a lace guide on one side of the upper;

coupling a first end of the lace guide at a first attachment location adjacent a junction between the upper and the sole;

folding a second end of the lace guide toward an opposite side of the upper to form a loop; and coupling the second end of the lace guide at a second attachment location adjacent the tightening edge to form the loop in the lace guide;

wherein a length of the lace guide is longer than a distance between the first and second attachment locations such that when tension is applied to the lace via the tightening mechanism, a portion of the loop is pulled toward an opposite side of the footwear and is closer to the opposite side of the footwear than the tightening edge.

14. The method of claim 13, wherein the lace guide is a fabric strap.

15. The method of claim 13, further comprising positioning the lace guide on an exterior surface of the upper.

16. The method of claim 13, further comprising coupling a plurality of lace guides with a first side and a second side of the footwear.

17. The method of claim 16, further comprising crisscrossing a first lace guide and a second lace guide about the footwear.

18. The method of claim 13, wherein the lace guide is a first lace guide positioned on a first side of the footwear, and wherein the method further comprises coupling a second lace guide with the first side of the footwear so that the first and second lace guides are angled toward one another to operatively guide a portion of the lace from across an opening of the footwear, along the tightening edge, and back across the opening of the footwear.

19. The method of claim 13, wherein coupling the first end of the lace guide at the first attachment location includes attaching the first end of the lace guide to the footwear at the junction between the upper and the sole.

20. The method of claim 13, wherein coupling the second end of the lace guide at the second attachment location includes attaching the second end of the lace guide to the tightening edge.

* * * * *